US006824437B2

(12) United States Patent
Jindai et al.

(10) Patent No.: US 6,824,437 B2
(45) Date of Patent: Nov. 30, 2004

(54) ELECTRON-EMITTING DEVICE, ELECTRON SOURCE, AND MANUFACTURE METHOD FOR IMAGE-FORMING APPARATUS

(75) Inventors: Kazuhiro Jindai, Yokohama (JP); Toshikazu Ohnishi, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 181 days.

(21) Appl. No.: 10/320,394

(22) Filed: Dec. 17, 2002

(65) Prior Publication Data

US 2003/0104751 A1 Jun. 5, 2003

Related U.S. Application Data

(62) Division of application No. 09/512,104, filed on Feb. 24, 2000, now Pat. No. 6,582,268.

(30) Foreign Application Priority Data

Feb. 25, 1999 (JP) ..... 11-049218
Feb. 26, 1999 (JP) ..... 11-051497
Feb. 24, 2000 (JP) ..... 2000-052227

(51) Int. Cl.[7] ..... H01J 9/02
(52) U.S. Cl. ..... 445/6; 445/24
(58) Field of Search ..... 445/6, 24

(56) References Cited

U.S. PATENT DOCUMENTS

| | | | | |
|---|---|---|---|---|
| 5,066,883 | A | 11/1991 | Yoshioka et al. | 313/309 |
| 5,591,061 | A | 1/1997 | Ikeda et al. | 445/3 |
| 5,754,427 | A | 5/1998 | Akagiri | 364/400.01 |
| 5,998,924 | A | 12/1999 | Yamamoto et al. | 313/496 |
| 6,179,678 | B1 | 1/2001 | Kishi et al. | 445/24 |
| 6,246,168 | B1 | 6/2001 | Kishi et al. | 313/495 |

FOREIGN PATENT DOCUMENTS

| | | |
|---|---|---|
| EP | 0 660 357 | 6/1995 |
| EP | 0 692 809 | 1/1996 |
| EP | 0 701 265 | 3/1996 |
| EP | 0 800 198 | 10/1997 |
| EP | 0 908 916 | 4/1999 |
| EP | 0 955 662 | 11/1999 |
| JP | 64-31332 | 2/1989 |
| JP | 1-283749 | 11/1989 |
| JP | 2-57552 | 2/1990 |
| JP | 7-192614 | 7/1995 |
| JP | 7-235255 | 9/1995 |
| JP | 8-7749 | 1/1996 |
| JP | 8-321254 | 12/1996 |
| JP | 9-6399 | 1/1997 |
| JP | 9-69333 | 3/1997 |
| JP | 9-326241 | 12/1997 |
| JP | 10-50206 | 2/1998 |
| KR | 97-71896 | 11/1997 |
| KR | 1998-013836 | 5/1998 |

OTHER PUBLICATIONS

C. A. Spindt, et al., "Physical Properties of Thin–Film Field Emission Cathodes with Molybdenum Cones", Journal of Applied Physics, vol. 47, No. 12, pp. 5248–5263, 1976, no month.

*Primary Examiner*—Joseph Williams
(74) *Attorney, Agent, or Firm*—Fitzpatrick, Cella, Harper & Scinto

(57) ABSTRACT

A method of manufacturing an electron-emitting device has a step of forming a pair of conductors on a substrate, the conductors being spaced from each other, and an activation process of depositing carbon or carbon compound on at least one side of the pair of conductors in an atmosphere of carbon compound gas. The activation process includes a plurality of processes of two or more stages including a first process and a second process. The first process is executed in an atmosphere of the carbon compound gas having a partial pressure higher than a partial pressure of the gas in the second process, with the second process being the last activation process.

16 Claims, 30 Drawing Sheets

ELECTRON-EMITTING DEVICE, ELECTRON SOURCE, AND MANUFACTURE METHOD FOR IMAGE-FORMING APPARATUS

This is a divisional application of application Ser. No. 09/512,104, filed on Feb. 24, 2000, now U.S. Pat. No. 6,582,268.

BACKGROUND OF THE INVENTION

1. Field of the Invention

The present invention relates to techniques regarding a method of manufacturing electron-emitting devices, a method of manufacturing an electron source, and a method of manufacturing an image-forming apparatus using an electron source.

2. Related Background Art

Of electron-emitting devices, a surface conduction electron-emitting device utilizes the phenomenon that electrons emit when current flows through a thin film having a small area formed on a substrate in parallel to the film plane. Japanese Patent Application Laid-Open No. 7-235255 discloses a surface conduction electron-emitting device using a metal thin film of Pd or the like. This device structure is shown in FIGS. 1A and 1B. In FIGS. 1A and 1B, reference numeral 1 represents a substrate. Reference numeral 4 represents an electroconductive film which is a metal oxide thin film of Pd or the like. This film is subjected to an energization process called an energization forming operation to be later described to locally destruct, deform or decompose the electroconductive film 4 and form a gap 5 having high electric resistance.

In order to improve the electron emission characteristics, an operation called "activation" to be described later is executed in some cases to form an electron-emitting region and films (carbon film) made of carbon and carbon compound near the electron-emitting region This process may be performed by a method of depositing carbon and carbon compound near the electron-emitting region by applying a pulse voltage to the device in an atmosphere which contains organic substance (EP-A-660357, Japanese Patent Application Laid-Open Nos. 07-192614, 07-235255, 08-007749).

Since the surface conduction electron-emitting device has a simple structure and is easy to manufacture, it has an advantage that a number of devices can be arranged in a large area. Various applications utilizing such characteristics have been studied. For example, applications to a charged beam source, a display apparatus and the like are known. One example of an electron source having a number of surface conduction electron-emitting devices is an electron source in which a number of rows are disposed and both ends of each of surface conduction electron-emitting devices disposed in parallel are connected by wirings (also called common wires) (e.g., publications of Japanese Patent Application Laid-Open Nos. 64-031332, 1-283749, 2-57552 and the like).

One example of applications is an image-forming apparatus such as a display apparatus in which an electron source having a number of surface conduction electron-emitting devices is combined with a phosphor which emits visual light when an electron beam is applied from the electron source (e.g., U.S. Pat. No. 5,066,883).

In order to retain uniformity of display images of such image-forming apparatus, various improvements on the forming and activation processes have been proposed. One approach is to judge the completion timing of the activation process from the electrical characteristics during this process (e.g., Japanese Patent Application Laid-Open No. 9-6399).

In addition to surface conduction electron-emitting devices, field emission electron-emitting devices (FE: Field Emitter) are known as another type of an electron-emitting device. One example of FE is a Spindt type. The Spindt type FE is a fine cold cathode constituted of a small conical emitter with a control electrode (gate electrode) formed very near the emitter and having a function of attracting electrons from the emitter and controlling a current quantity. A cold cathode having Spindt type FEs disposed in an array has been proposed by C. A. Spindt, et. al. (C. A. Spindt, "A Thin-Film Field-Emission Cathode", Journal of Applied Physics, Vol. 39, No. 7, p. 3504, 1968).

Techniques for improving an electron emission efficiency of FE has been recently disclosed (Japanese Patent Application Laid-Open No. 10-50206) in which a voltage is applied across the gate electrode and the cathode electrode connected to the emitter in an atmosphere containing organic substance to deposit carbon compound on the emitter surface One example of an electron source substrate with a number of electron-emitting devices is a simple matrix electron source substrate with electron-emitting devices disposed in a matrix shape of N rows and M columns. When an activation process is performed to deposit carbon or carbon compound on such a substrate, a voltage is applied to the common wires of N rows and M columns connected to device electrodes.

For example, the following methods are performed for the activation process.

(1) A voltage is sequentially applied one line after another from the first row to N-th row.

(2) N rows are divided into several blocks, and a pulse is sequentially applied to each block by shifting the phase. This process is a scroll activation process.

In both the cases (1) and (2), as the number of devices becomes large, it takes a long time to execute the activation process. If the number of blocks of N rows is made small in the case (2), a duty factor of the voltage applied to each row becomes small. Therefore, an activation speed may lower or the electron emission quantity or efficiency may lower so that good electron-emitting devices cannot be manufactured.

One proposed approach to shortening the activation time is to increase the number of lines to which a voltage is applied at the same time. However, this approach is associated with some problems. Namely, the activation process deposits carbon or carbon compound on the electron-emitting region and its nearby area, by decomposing organic substance attached to the device substrate from the atmosphere. Therefore, as the number of devices for which the activation process is executed at the same time, increases, the amount of organic substance decomposed and consumed per unit time on the electron source substrate increases. This results in a variation of the concentration of organic substance in the atmosphere, a lowered carbon film forming speed, and a variation in carbon films depending upon the position in the electron source substrate. Uniformity of manufactured electron sources is therefore degraded.

SUMMARY OF THE INVENTION

It is an object of the invention to provide a method of manufacturing electron-emitting devices and an electron source, capable of performing an activation process in a short time.

It is another object of the present invention to provide a method of manufacturing electron-emitting devices and an electron source, capable of forming a carbon or carbon compound film of good crystallinity by a short time activation process.

It is another object of the present invention to provide a method of manufacturing an electron source having a plurality of electron-emitting elements, capable of executing the activation process in a short time.

It is another object of the present invention to provide a method of manufacturing an electron source having a plurality of electron-emitting devices of good uniformity, capable of executing the activation process in a short time.

It is another object of the present invention to provide a method of manufacturing an image-forming apparatus with uniform luminance characteristics.

The present invention provides a method of manufacturing an electron-emitting device comprising a step of forming a pair of conductors on a substrate, the conductors being spaced from each other, and an activation process of depositing carbon or carbon compound on at least one side of the pair of conductors in an atmosphere of carbon compound gas, wherein the activation process includes a plurality of processes of two or more stages including a first process and a second process, and the first process is executed in an atmosphere of the carbon compound gas having a partial pressure higher than a partial process of the second process used as a last activation process.

The present invention also provides a method of manufacturing an electron-emitting device comprising a step of forming an electroconductive film including an electron-emitting region and disposed between electrodes, and an activation process of depositing carbon or carbon compound on the electroconductive film in an atmosphere of carbon compound gas, wherein the activation process includes a plurality of processes of two or more stages including a first process and a second process, and the first process is executed in an atmosphere of the carbon compound gas having a partial pressure higher than a partial process of the second process used as a last activation process.

The present invention also provides a method of manufacturing an electron source comprising a step of forming plural pairs of conductors on a substrate, the conductors being spaced from each other, and an activation process of depositing carbon or carbon compound on at least one side of each of the plural pairs of conductors in an atmosphere of carbon compound gas, wherein the activation process includes a plurality of processes of two or more stages including a first process and a second process, and the first process is executed in an atmosphere of the carbon compound gas having a partial pressure higher than a partial process of the second process used as a last activation process.

The present invention also provides a method of manufacturing an electron source comprising a step of forming a plurality of electroconductive films each including an electron-emitting region and disposed between electrodes, and an activation process of depositing carbon or carbon compound on each of the plurality of electroconductive films in an atmosphere of carbon compound gas, wherein the activation process includes a plurality of processes of two or more stages including a first process and a second process, and the first process is executed in an atmosphere of the carbon compound gas having a partial pressure higher than a partial process of the second process used as a last activation process.

The present invention also provides a method of manufacturing an image-forming apparatus comprising a step of disposing a frame member facing the electron source manufactured according to any one of the electron source manufacture methods described above, the frame member including an image-forming member for forming an image by an electron beam emitted from the electron source.

DETAILED DESCRIPTION OF THE PREFERRED EMBODIMENTS

Figure 1A:
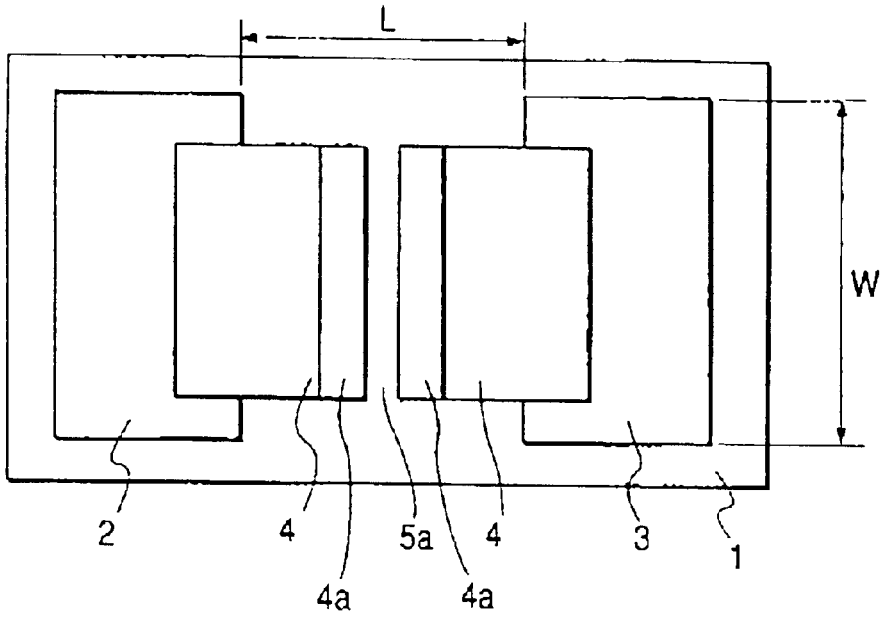
FIGS. 1A and 1B are schematic diagrams showing an example of an electron-emitting device manufactured by a manufacture method according to the present invention.

The present invention provides a method of manufacturing an electron-emitting device comprising a step of forming a pair of conductors on a substrate, the conductors being spaced from each other, and an activation process of depositing carbon or carbon compound on at least one side of the pair of conductors in an atmosphere of carbon compound gas, wherein the activation process includes a plurality of processes of two or more stages including a first process and a second process, and the first process is executed in an atmosphere of the carbon compound gas having a partial pressure higher than a partial process of the second process used as a last activation process.

The present invention also provides a method of manufacturing an electron-emitting device comprising a step of forming an electroconductive film including an electron-emitting region and disposed between electrodes, and an activation process of depositing carbon or carbon compound on the electroconductive film in an atmosphere of carbon compound gas, wherein the activation process includes a plurality of processes of two or more stages including a first process and a second process, and the first process is executed in an atmosphere of the carbon compound gas having a partial pressure higher than a partial process of the second process used as a last activation process.

The present invention also provides a method of manufacturing an electron source comprising a step of forming plural pairs of conductors on a substrate, the conductors being spaced from each other, and an activation process of depositing carbon or carbon compound on at least one side of each of the plural pairs of conductors in an atmosphere of carbon compound gas, wherein the activation process includes a plurality of processes of two or more stages including a first process and a second process, and the first process is executed in an atmosphere of the carbon compound gas having a partial pressure higher than a partial process of the second process used as a last activation process.

The present invention also provides a method of manufacturing an electron source comprising a step of forming a plurality of electroconductive films each including an electron-emitting region and disposed between electrodes, and an activation process of depositing carbon or carbon compound on each of the plurality of electroconductive films in an atmosphere of carbon compound gas, wherein the activation process includes a plurality of processes of two or more stages including a first process and a second process, and the first process is executed in an atmosphere of the carbon compound gas having a partial pressure higher than a partial process of the second process used as a last activation process.

In the above-described electron source manufacture methods:

- the partial pressure of the carbon compound gas in the first process may be $5\times10^{-4}$ Pa or higher;
- the partial pressure of the carbon compound gas in the second process may be $5\times10^{-3}$ Pa or lower;
- a deposition amount of carbon or carbon compound during the first process may be larger than a deposition amount of carbon or carbon compound during the second process;
- a deposition amount of carbon or carbon compound during the first process may be 70% or larger than a deposition amount of carbon or carbon compound after the second process and succeeding processes;
- the first process may be terminated in accordance with an evaluation result of electrical characteristics of each of the plural pairs of conductors;
- the electrical characteristics may be a device current flowing through each of the plural pairs of conductors;
- the first process may be terminated when the device current exceeds a reference value which is equal to or larger than a device current obtained when the second process is terminated;
- the first process may be terminated after a predetermined time after the device current exceeds a reference value which is equal to or larger than a device current obtained when the second process is terminated;
- the electrical characteristics may be a device current at a voltage (Vf) lower than a voltage (Vf) used in the activation step;
- it may be Vf=Vf/2;
- the electrical characteristics may be a device current flowing through each of the plural pairs of conductors and an emission current emitted from a corresponding conductor pair;
- the electrical characteristics may be a ratio of the emission current to the device current;
- when the partial pressure of the carbon compound is lowered after the first process for all of the plural pairs of conductors on the substrate is terminated, a voltage may not applied to each of the plural pairs of conductors;
- the partial pressure of the carbon compound may be lowered by lowering a flow rate of carbon compound introduced from a carbon compound supply source into the atmosphere;
- the activation step of depositing carbon or carbon compound may include a step of applying a voltage to each of the plural pairs of conductors in the atmosphere of the carbon compound gas;
- the step of forming plural pairs of conductors may include a step of applying a voltage to each of the plural pairs of conductors on the substrate; or
- each of the plural pairs of conductors may include a pair of electroconductive films spaced from each other and a pair of electrodes respectively connected to the pair of electroconductive films.

The present invention also provides a method of manufacturing an image-forming apparatus comprising a step of disposing a frame member facing the electron source manufactured according to any one of the electron source manufacture methods described above, the frame member including an image-forming member for forming an image by an electron beam emitted from the electron source.

With the above-described methods of manufacturing electron-emitting devices, it is possible to form a carbon film or a carbon compound film of good crystallinity and stabilize the characteristics.

With the above-described methods of manufacturing an electron source, even if the activation process is performed at the same time for a plurality of devices, a supply amount of carbon compound gas will not become insufficient. It is therefore possible to suppress uniformity of the electron emission characteristics from being degraded, which might otherwise be caused by an insufficient supply amount of carbon compound gas.

Furthermore, the final process is executed for depositing carbon or carbon compound at a low partial pressure of the carbon compound gas. Since the electron emission characteristics are optimized, uniformity can be improved.

With the methods of manufacturing an electron source with a plurality of electron-emitting devices according to the present invention, the activation process is executed at the same time for a plurality of devices and the electron source having more uniform electron emission characteristics can be manufactured. Therefore, a tact time of the manufacture process is shortened so that the production cost lowers. It is therefore possible to provide inexpensive and highly uniform electron sources and an inexpensive and high quality image-forming apparatus.

The electron-emitting device according to the present invention emits electrons when a voltage is applied across a pair of conductors of the device disposed on a substrate and spaced from each other. The electron-emitting device of this invention is intended to be inclusive of the surface conduction electron-emitting device and a field emission electron-emitting device called FE.

In the case of FE, the conductor pair corresponds to the emitter and the gate electrode, and carbon or carbon compound is deposited on the emitter.

In the case of a surface conduction electron-emitting device, the conductor pair corresponds to a pair of electroconductive films to be later detailed, and carbon or carbon compound is deposited on one or both of paired electroconductive films.

Preferred modes of the invention will be described by taking surface conduction electron-emitting devices as an example of the electron-emitting device.

Figure 1B:
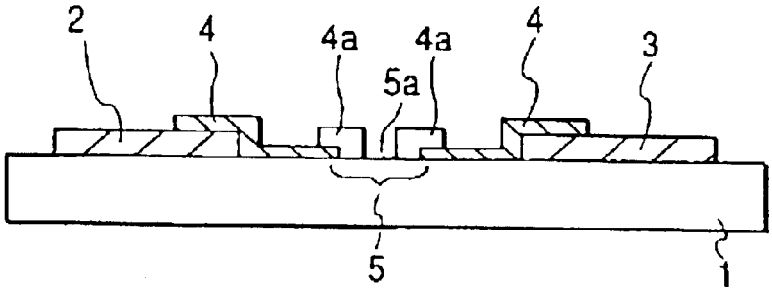

FIGS. 1A and 1B are diagrams showing the structure of a surface conduction electron-emitting device. FIGS. 1A and 1B are a plan view and a cross sectional view, respectively. In FIGS. 1A and 1B, reference numeral 1 represents a substrate, reference numerals 2 and 3 represent device electrodes, reference numeral 4 represents a pair of electroconductive films respectively connected to the device electrodes 2 and 3, with a first gap 5 being interposed between the films 4, and reference numeral 4*a* represents carbon films having carbon or carbon compound as their main component and disposed on the conductive films 4 and between the first gap 5, forming a second gap 5*a* narrower than the first gap 5.

As a voltage is applied across the device electrodes 2 and 3 of the surface conduction electron-emitting device, electrons are emitted from the electroconductive films.

The substrate 1 may be a quartz glass substrate, a glass substrate with a reduced content of impurities such as Na, a soda lime glass substrate, a soda lime glass substrate laminated with a sputtered $SiO_2$ film, a ceramic substrate such as alumina, an Si substrate or the like. A device electrode distance L, a device electrode length W, the shape of the electroconductive films 4 and the like are designed by taking into consideration the application fields or the like. Instead of the structure shown in FIGS. 1A and 1B, a lamination structure of the electroconductive films 4 and the opposing device electrodes 2 and 3 stacked in this order on the substrate 1 may also be used In order to obtain good electron emission characteristics, the electroconductive films 4 are preferably made of a fine particle film made of fine particles. The thickness of the electroconductive film is properly set by taking into consideration the step coverage to the device electrodes 2 and 3, the resistance value between the device electrodes 2 and 3, the forming conditions to be described later, and the like. Generally, it is preferable to set the film thickness in a range from a several multiple of 0.1 nm to several hundred nm, or more preferably in a range from 1 nm to 50 nm. The resistance value Rs of the electroconductive film 4 is in a range from $10^2$ to $10^7$ Ω/□. Rs is given by R=Rs (l/w) where R is a resistance of a thin film having a thickness t, a width w and a length l.

The forming process will be described by taking as an example an energization process. The forming process is not limited only to the energization process, but may include other processes capable of forming a gap such as fissures in the film and providing a high resistance state.

The material of the electroconductive film 4 is properly selected from a group consisting of metal such as Pd, Pt, Ru, Ag, Au, Ti, In, Cu, Cr, Fe, Zn, Sn, Ta, W and Pd, and oxide such as PdO, $SnO_2$, $In_2O_3$, PbO, $Sb_2O_3$. The fine particle film is a film made of a collection of a plurality of fine particles. The micro structure of the fine particle film takes a state that fine particles are separately dispersed or a state that fine particles are disposed adjacently or in a superposed manner (including a state of an island structure each island being formed by a collection of several fine particles). The diameter of a fine particle is in a several multiple of 0.1 nm to several hundred nm, or more preferable in a range from 1 nm to 20 nm.

The first gap 5 is constituted of fissures or the like partially formed in the electroconductive films 4. The structure of the electroconductive film 4 depends upon the thickness, quality, and material of the film and manufacture processes such as energization forming to be described later. The carbon films 4*a* of carbon or carbon compound are formed in the first gap 5 and its nearby electroconductive films 4.

An example of a manufacture method for electron-emitting devices will be described with reference to FIGS. 2A to 2D and FIG. 6. In FIGS. 2A to 2D and FIG. 5, like elements to those shown in FIGS. 1A and 1B are represented by using identical reference numerals.

Figure 2A:
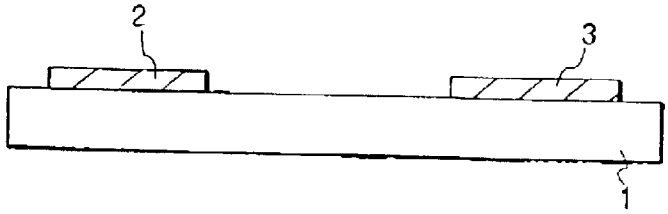
FIGS. 2A, 2B, 2C and 2D are diagrams illustrating a manufacture method for electron-emitting devices according to the present invention.

1) A substrate 1 is cleaned sufficiently by using cleaning agent, pure water, organic solvent or the like. After device electrode material is deposited by vacuum evaporation, sputtering or the like, device electrodes 2 and 3 are formed on the substrate 1, for example, by photolithography techniques (FIG. 2A).

Figure 2B:
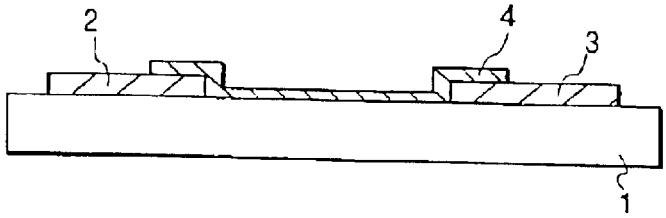

2) Organic metal solution is coated on the substrate 1 with the device electrodes 2 and 3 to form an organic metal thin film. The organic metal solution may be solution of organic metal compound containing the above-described metal material of the electroconductive film 4 as its main element. The electroconductive film 4 is formed by subjecting the organic metal thin film to a heating and baking process and then patterning it through lift-off, etching and the like (FIG. 2B). The method of forming the electroconductive film 4 is not limited to the method of coating organic metal solution, but other methods may be used such as vacuum evaporation, sputtering, chemical vapor deposition, dispersion coating, dipping, and spinning.

Figure 2C:
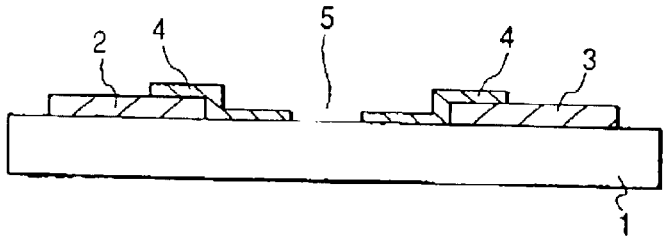
Figure 3A:
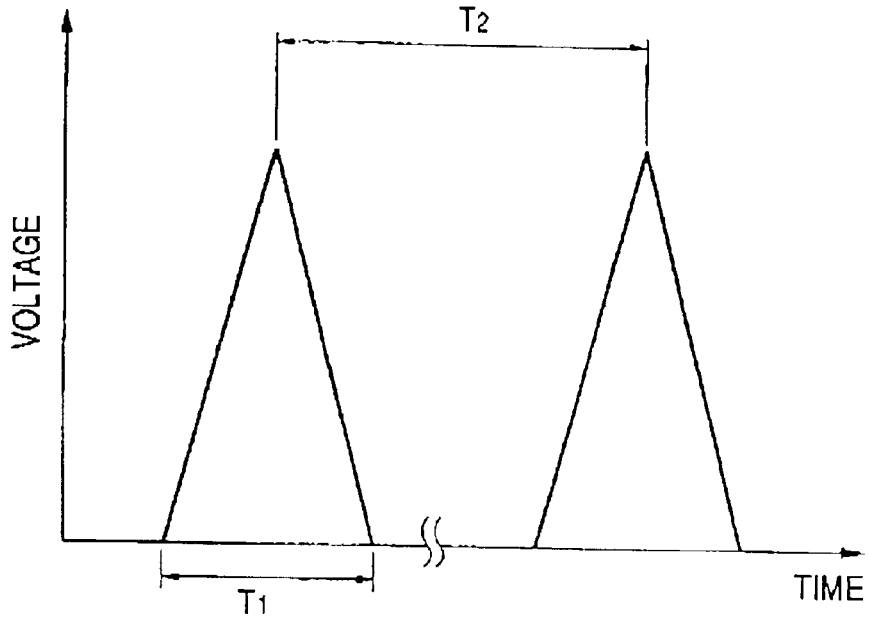
FIGS. 3A and 3B show examples of a forming voltage.
Figure 3B:
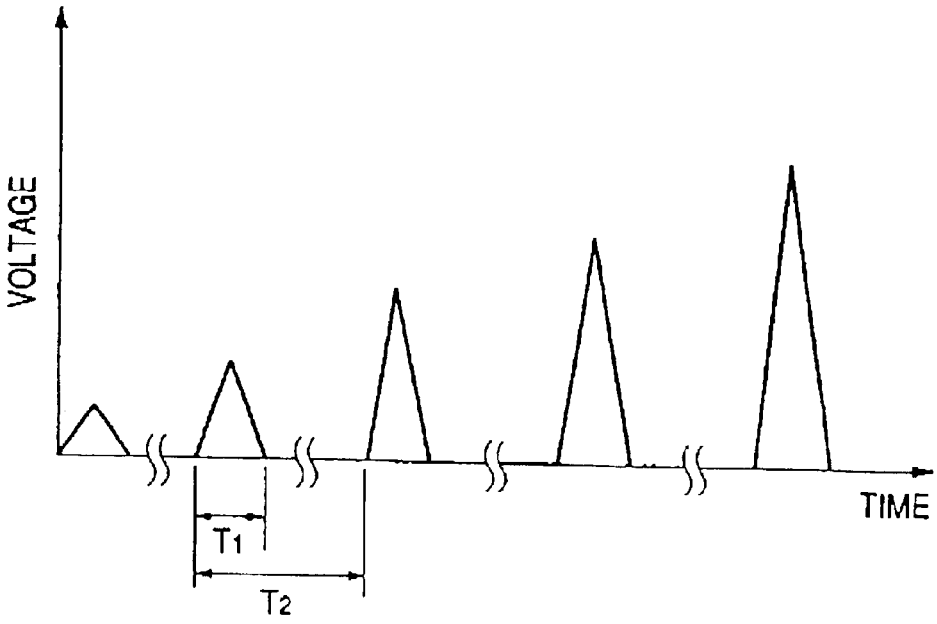

3) Next, a forming process is performed. An energization process will be described as one example of the forming process. As a power is supplied across the device electrodes 2 and 3 from an unrepresented power source, an electron-emitting region with a changed structure is formed in the electroconductive thin film 4 (FIG. 2C). This energization forming process forms a first gap 5 in the electroconductive thin film 4. The first gap 5 forms the electron-emitting region In the electroconductive film 4. As a voltage is applied across the device electrodes 2 and 3, electrons are emitted from an area near the first gap 5. Voltage waveforms for the energization forming are shown in FIGS. 3A and 3B. The voltage waveform is preferably a pulse waveform. One approach to applying the voltage is to sequentially applying a voltage pulse having a constant pulse peak value as shown in FIG. 3A, and another approach is to sequentially applying a voltage pulse while its pulse peak value is increased as shown in FIG. 3B.

4) A process called an energization operation is performed after the forming process of the device. The activation process is a process of considerably changing a device current If and an emission current Ie. For example, the activation process is performed by repetitively applying a pulse voltage similar to the energization forming, in an atmosphere which contains carbon compound gas such as organic substance gas. The preferable gas pressure of organic substance depends on the application field, the shape of a vacuum envelope, the kind of organic substance, and the like. Therefore, a proper gas pressure is determined in accordance with each case.

Figure 2D:
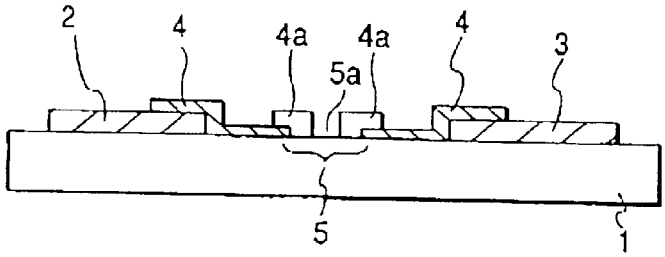

With this activation operation, carbon films 4*a* of carbon or carbon compound supplied from the organic substance in the atmosphere are deposited on the conductive films 4 and in the first gap 1, and a second gap 5*a* narrower than the first gap 5 is formed in and along the first gap 5 (FIG. 2D). The device current If and emission current Ie are therefore changed greatly.

The carbon or carbon compound is intended to be inclusive of graphite (so-called HOPG, PG and GC) and amorphous carbon (amorphous carbon, and mixture of amorphous carbon and graphite fine crystals). HOPG has a nearly perfect crystal structure of graphite, PG has a slightly disturbed crystal structure having the crystal grain of about 20 nm, and GC has a more disturbed crystal structure having the crystal grain of about 2 nm. The thickness of the carbon film is preferably in a range of 50 nm or thinner, or more preferably in a range of 30 nm or thinner.

Suitable organic substance usable by the invention includes: aliphatic hydrocarbon such as alkane, alkene and alkyne; aromatic hydrocarbon; alcohol; aldehyde; ketone; amine; organic acid such as phenol acid, carboxylic acid and sulfonic acid; and the like. More specifically, usable organic substance includes: saturated hydrocarbon expressed by a composition formula $C_nH_{2n+2}$, such as methane, ethane and propane; unsaturated hydrocarbon expressed by composition formulas such as $C_nH_{2n}$, $C_nH_{2n}$ and $C_nH_{2n-2}$, such as ethylene, propylene, acetylene; benzene; methanol; ethanol; formaldehyde; acetaldehyde; acetone; methylethyl ketone; methylamine; ethylamine; phenol; formic acid; acetic acid; propionic acid; and the like.

In this embodiment, these organic substances may be used singularly or may be used as a mixture. Each of these organic substances may be diluted with other gas. Gas usable as dilution gas is, for example, inert gas such as nitrogen, argon and xenon.

The invention is characterized in that the activation process includes a plurality of processes having at least two stages. The invention is particularly characterized in that the partial pressure of organic substance in an atmosphere in the first stage activation process is larger than that in the second stage activation process.

The first stage activation process is a process of depositing the carbon films on the electron-emitting region formed by the forming process. Therefore, it can be considered that this first stage activation process has a large consumption amount of organic substance. It is therefore preferable to increase the partial pressure so that even if the organic substance is consumed, a variation of the partial pressure of the organic substance in the activation atmosphere can be suppressed small. This is effective for achieving uniformity of the characteristics of a number of electron-emitting devices of an electron source when they are activated.

The second stage activation process is considered as a process of reinforcing the carbon films deposited at the first stage process. The device activated by the first stage process is in a state that the device current flows because of the deposition of the carbon films and also in a state of emitting electrons. As compared to the first stage activation process, the second stage activation process is performed in an atmosphere at a lower partial pressure of organic substance and the deposition speed of carbon or carbon compound in an area near the fissures lowers. It can therefore be presumed that most of local heat generated by the device current and most of energy in the area near the fissures generated upon application of emission electrons are utilized for improving the crystallinity of the deposited carbon films.

Figure 4A:
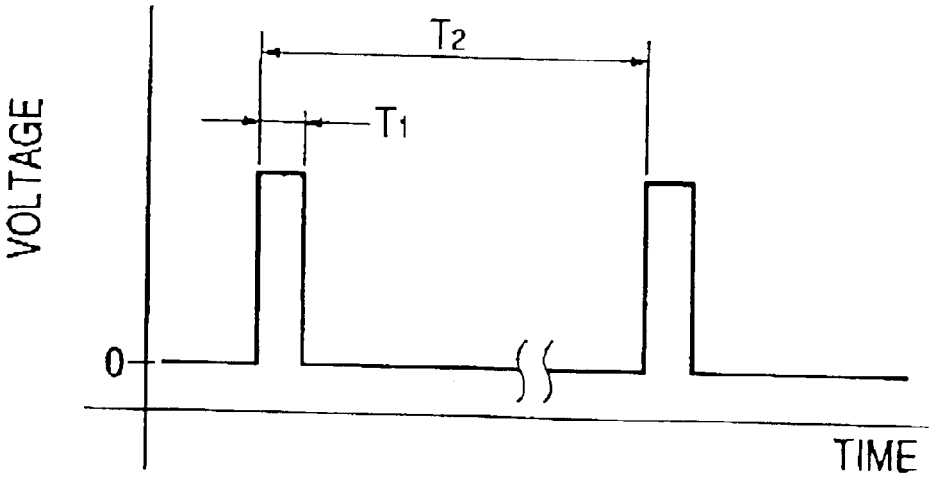
FIGS. 4A and 4B show examples of an activation voltage.
Figure 4B:
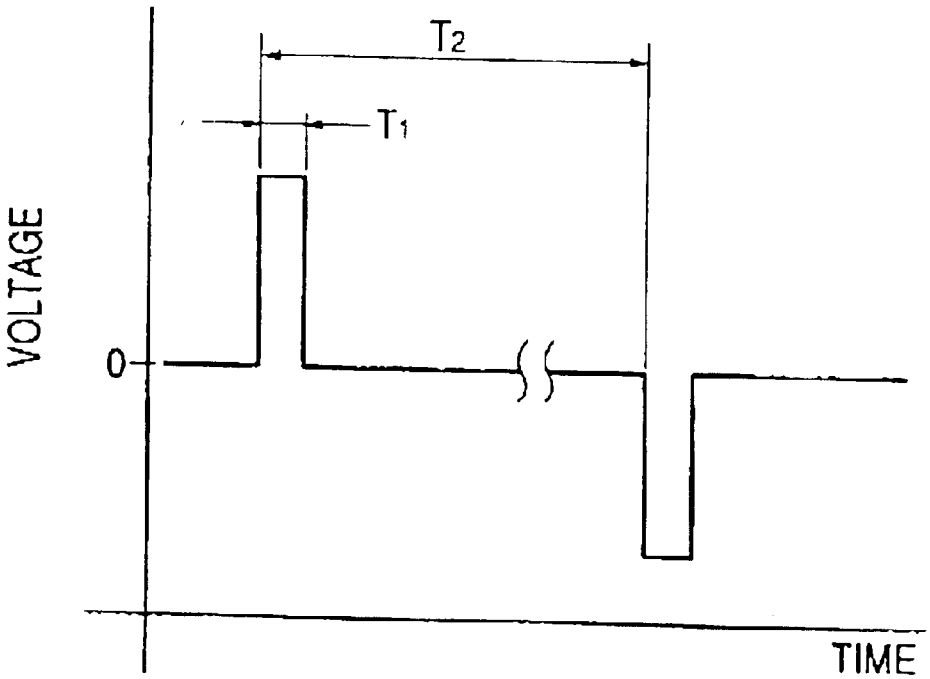

The method of applying a voltage during the activation process of this invention is determined depending upon a change in the voltage value with time, a direction of applying a voltage, a voltage waveform and the like. The voltage may be changed with time by raising its value, or a constant voltage may be applied. The direction of applying a voltage may be a direction (forward direction) same as that used for actually driving the electron source as shown in FIG. 4A, or may be alternately changed between the forward direction and backward direction as shown in FIG. 4B. The method of applying a voltage alternately in the forward and backward directions is preferable because it can be expected that the carbon film is formed symmetrically with fissures. Although the waveform of the voltage shown in FIGS. 4A and 4B is rectangular, other optional shapes may also be used, such as sine waves, triangular waves and sawtooth waves.

5) It is preferable to perform a stabilization process for the electron-emitting devices subjected to the above-described processes. The stabilization process is a process of removing organic substance from the vacuum envelope. An evacuation apparatus for evacuating the inside of a vacuum envelope is preferably such an apparatus which does not use oil so as not to affect the characteristics of devices by oil. For example, the evacuation apparatus may be a sorption pump, an ion pump or the like. The partial pressure of organic substance in the vacuum envelope is set to a partial pressure which does not allow the carbon or carbon compound to be newly deposited. The partial pressure is preferably $1.3\times10^{-6}$ Pa or lower, or more preferably $1.3\times10^{-8}$ or lower.

In order to further evacuate the inside of the vacuum envelope, it is preferable to heat the whole of the vacuum envelope so as to facilitate the evacuation of organic substance molecules attached to the inner wall of the vacuum envelope and to the electron-emitting devices. The heating is desired to be performed as long as possible at a temperature range of 80 to 250° C. or more preferably at a temperature of 150° C. or higher. However, the heating conditions are not limited only thereto, but the heating conditions are properly determined from various conditions such as the size and shape of the vacuum envelope, the structure of the electron-emitting devices and the like. It is necessary to lower the pressure in the vacuum envelope as much as possible, and the pressure is preferably $1\times10^{-5}$ Pa or lower, or more preferably $1.3\times10^{-6}$ Pa or lower.

It is preferable to maintain the atmosphere immediately after the stabilization process even during the actual driving. However, such conditions are not limitative, but if the organic substance was sufficiently removed, sufficiently stable characteristics can be retained even if the pressure in the electron source raises more or less. By maintaining such a vacuum atmosphere, it is possible to suppress carbon or carbon compound from being newly deposited and to remove $H_2O$, $O_2$ and the like attached to the vacuum container and substrate. As a result, the device current If and emission current Ie can be stabilized.

The manufacture method of the invention is also applied to a method of manufacturing an electron source having a plurality of electron-emitting devices formed on a substrate.

For the layout of electron-emitting devices, a plurality of electron-emitting devices are disposed in a matrix shape in row and column directions, ones of electrodes of a plurality of electron-emitting devices disposed at the same row are connected in common to a row-directional wire, and others of electrodes of a plurality of electron-emitting devices disposed at the same column are connected in common to a column-directional wire. Such a layout is a so-called simple matrix layout.

The simple matrix layout will be described in detail.

Figure 5:
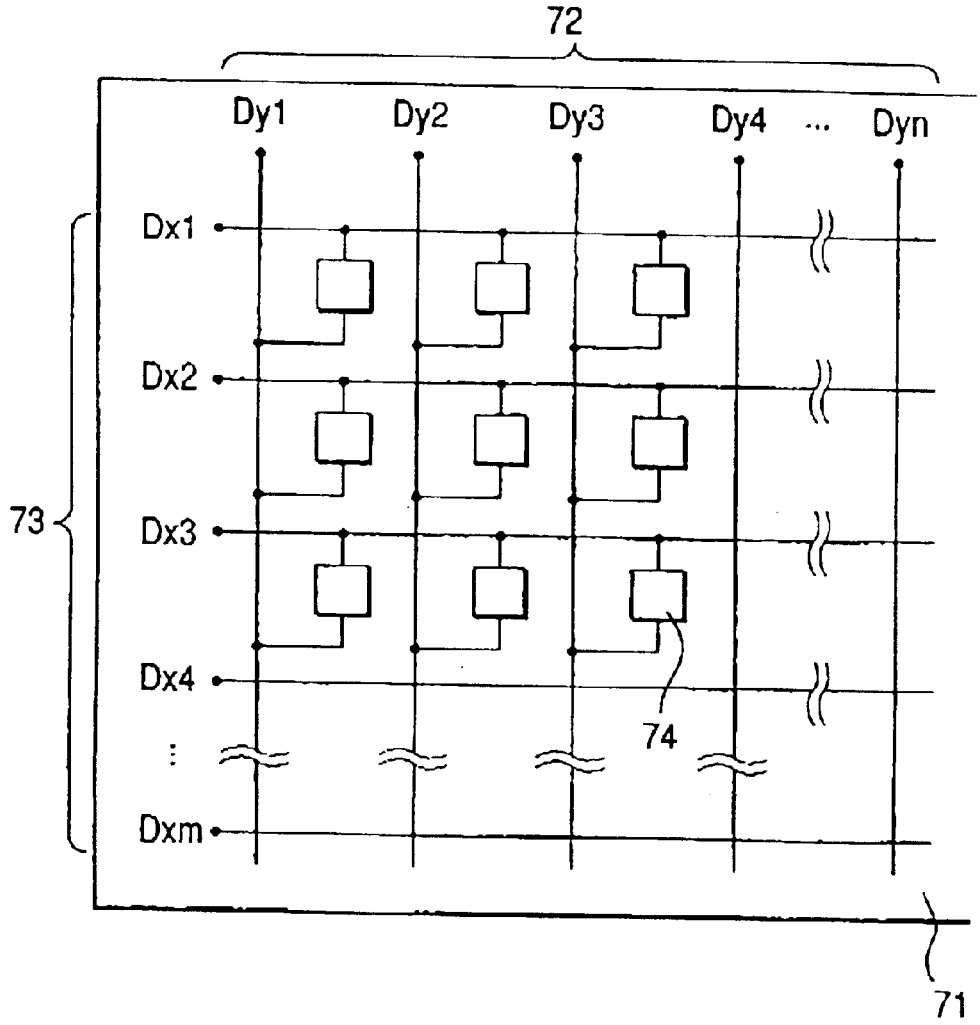
FIG. 5 is a schematic diagram showing a matrix layout of a plurality of electron-emitting devices.

In FIG. 5, reference numeral 71 represents an electron source substrate, reference numeral 72 represents column-directional wires, reference numeral 73 represents row-directional wires, reference numeral 74 represents electron-emitting devices.

These wires are made of conductive metal or the like formed through vacuum evaporation, printing, sputtering or the like. The material, thickness and width of each wire are designed properly. Unrepresented interlayer insulating films are formed between m row-directional wires 73 and n column-directional wires 72 to electrically insulate them (m and n are both a positive integer).

The unrepresented interlayer insulating film is made of $SiO_2$ or the like formed through vacuum evaporation, printing, sputtering or the like. For example, the interlayer insulating films having a desired shape are formed on the whole area or partial areas of the substrate 71 formed with the column-directional wires 72. The thickness, material and manufacture method are properly set so as to be resistant against a potential difference between the column-directional wires 72 and row-directional wires 73. The column-directional wires 72 and row-directional wires 73 are connected to external terminals. A pair of electrodes (not shown) of each electron-emitting device is electrically connected to one of the m row-directional wires 73 and one of the n column-directional wires 72.

Figure 6:
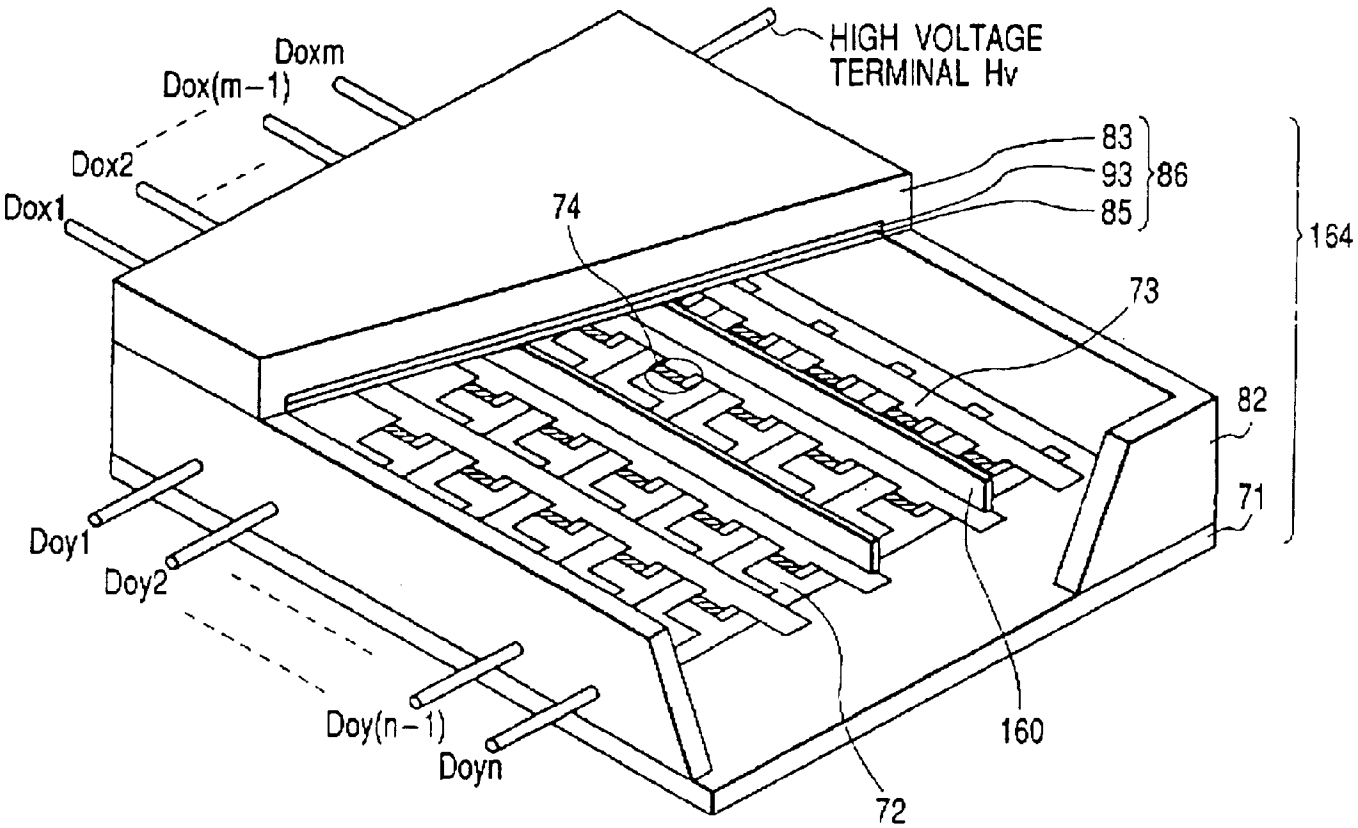
FIG. 6 is a perspective view of an image-forming apparatus manufactured by a manufacture method according to the present invention.
Figure 7A:
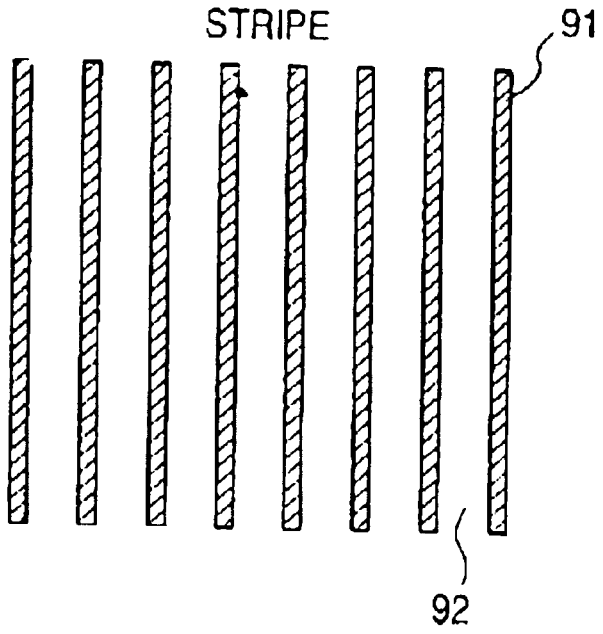
FIGS. 7A and 7B are diagrams showing examples of a fluorescent film.
Figure 7B:
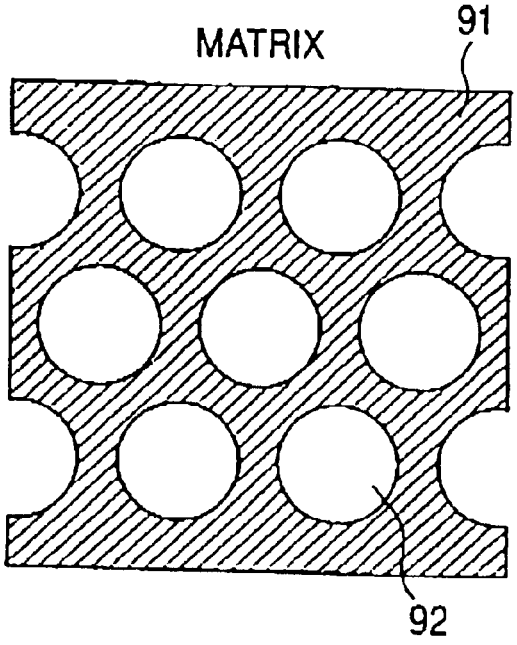
Figure 8:
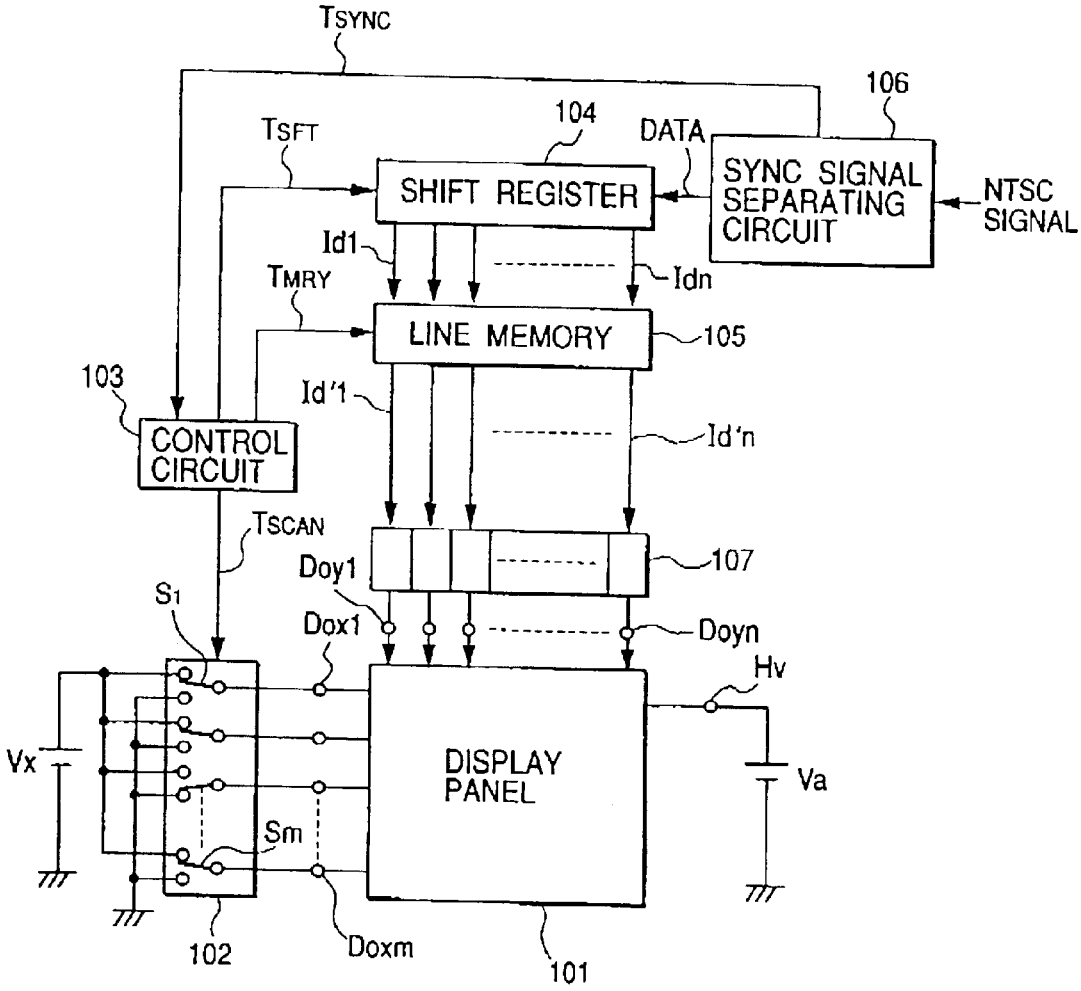
FIG. 8 is a circuit diagram showing an example of a driver circuit of an image-forming apparatus.

An image-forming apparatus using such a simple matrix layout electron source will be described with reference to FIG. 6, FIGS. 7A and 7B and FIG. 8. FIG. 6 is a schematic diagram showing an example of a display panel of the image-forming apparatus, and FIGS. 7A and 7B are schematic diagrams showing examples of a fluorescent film used by the image-forming apparatus shown in FIG. 6. FIG. 8 is a block diagram showing an example of a driver circuit for displaying an image in accordance with television signals of the NTSC system.

Referring to FIG. 6, reference numeral 71 represents an electron source substrate on which a plurality of electron-emitting elements 74 are disposed, and reference numeral 86 represents a face plate made of a glass substrate 83 with a fluorescent film 93, a metal back 85 and the like formed on the inner surface of the glass substrate. Reference numeral 82 represents a support frame on which the electron source substrate (rear plate) 71 and face plate 86 are bonded by low melting point frit glass or the like to form an envelope 164. Reference numerals 72 and 73 represents column- and row-directional wires connected to a pair of device electrodes of an electron-emitting device.

Spacers 169 are disposed between the face plate 86 and rear plate (electron source substrate) 71 so that the envelope 164 can have a sufficient strength resistant against the atmospheric pressure.

FIGS. 7A and 7B are schematic diagrams showing examples of a fluorescent film. For a monochrome fluorescent film, a fluorescent film 84 can be made of only single phosphor. For a color display fluorescent film, the fluorescent film 84 can be made of phosphors 92 and black color electroconductive material 91 called black stripes or black matrix depending on the layout of phosphors. The objective of providing the black stripes or black matrix is to make color mixture and the like not conspicuous by making a black area between respective phosphorss 92 of primary three colors, and to suppress the contrast from being lowered by external light reflection at the fluorescent film 84. The material of the black stripes may be the generally used material containing as its main component black lead, and in addition the material which is electroconductive and has less transmission and reflection of light.

The method of coating phosphor on the glass substrate 83 may be semidentating, printing or the like irrespective of whether the display is monochrome or color. The metal back 85 is generally mounted on the inner surface side of the fluorescent film 84. The objective of providing the metal back 85 is to improve the brightness by mirror-reflecting light emitted from the phosphor to the inner side and directing it toward the face plate 86, to use the metal back 85 as an electrode for applying an electron beam acceleration voltage, and to protect the phosphor from being damaged by collision of negative ions generated in the envelope, and the like. The metal back is formed in the manner that after the fluorescent film is formed, the inner surface of the fluorescent film is planarized (generally called "filming") and thereafter aluminum is deposited by vacuum evaporation or the like.

A transparent electrode (not shown) may be formed on the face plate 86 on the outer surface side of the fluorescent film 84 in order to improve the conductivity of the fluorescent film 84. When the envelope is hermetically sealed, it is essential that respective color phosphors of the fluorescent film and the electron-emitting devices are aligned in correct position.

An example of a method of manufacturing the image-forming apparatus shown in FIG. 6 will be described.

Figure 9:
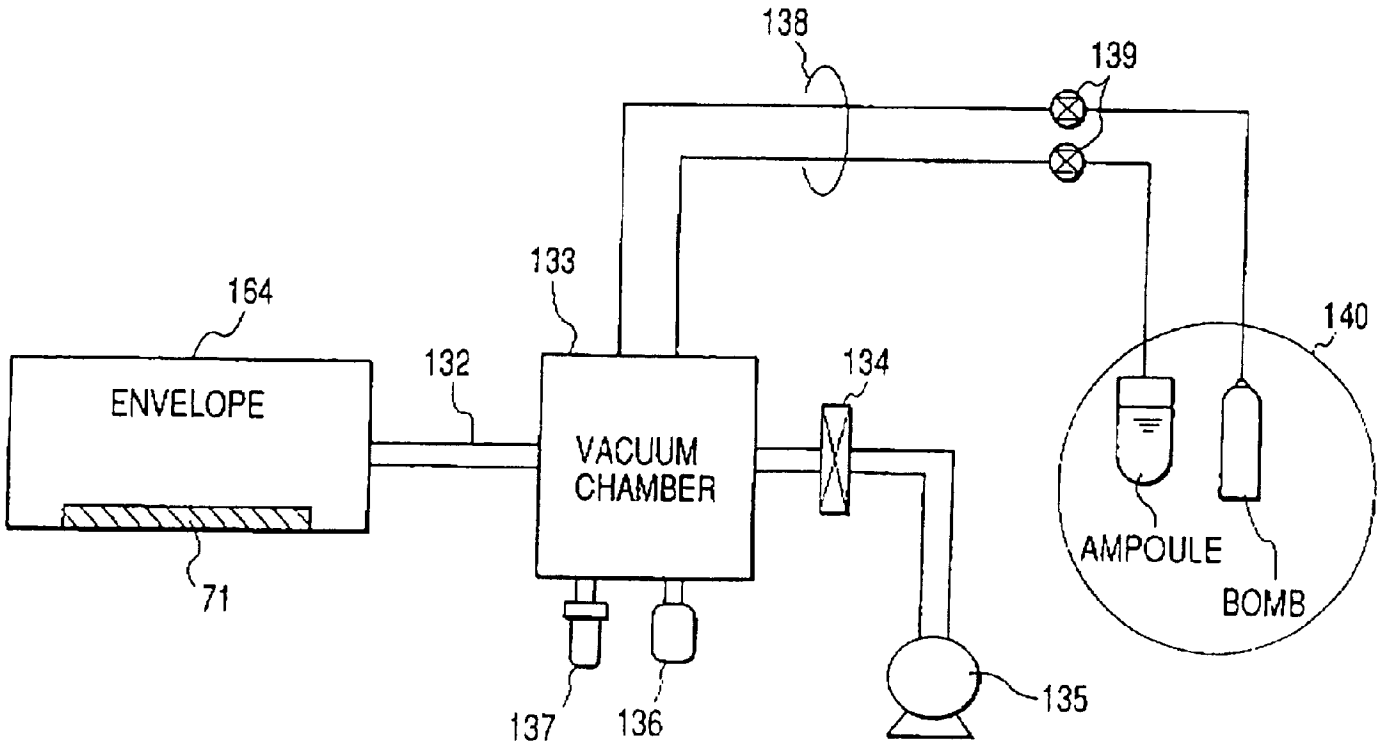
FIG. 9 is a schematic diagram showing an example of a vacuum system used for an activation process according to the present invention.

An air exhaust pipe 132 is provided to the envelope 164, and by using an evacuation system having the structure shown in FIG. 9, the forming process and succeeding processes can be performed. Referring to FIG. 9, the envelope 164 is coupled via the exhaust pipe 132 to a vacuum chamber 133 and via a gate valve 134 to an evacuator 135. A pressure gage 136, a quadrupole mass analyzer (Q-mass) 137 and the like are mounted on the vacuum chamber 133 in order to measure the pressure in the chamber 133 and partial pressures of respective components in the atmosphere.

It is difficult to directly measure the pressure in the envelope 164 and the like. Therefore, the pressure in the vacuum chamber 133 and the like are measured to control the operation conditions. Gas inlet pipes 138 are connected to the vacuum chamber 133 in order to introduce necessary gases into the atmosphere in the vacuum chamber. Introduction material sources 140 are connected to the other ends of the gas inlet pipes 138. The introduction materials are accommodated in an ampoule or a bomb.

A flow control means (gas flow control device) 139 is mounted at the intermediate position of the gas inlet pipe in order to control the flow rate of the gas to be introduced. The flow control unit may be a valve such as a slow leak valve capable of controlling a flow rate, an electromagnetic valve, a mass flow controller and the like, which can be selectively used depending upon the type of gas. By using the system shown in FIG. 9, the inside of the envelope 164 is degassed and then organic substance is introduced via the gas inlet pipe 138. A power source (not shown) is connected via a cable (not shown) to the external terminals of the row- and column-directional wires of the electron source substrate so that a voltage can be applied from the power source to the wires of the electron source substrate 71.

Figure 10:
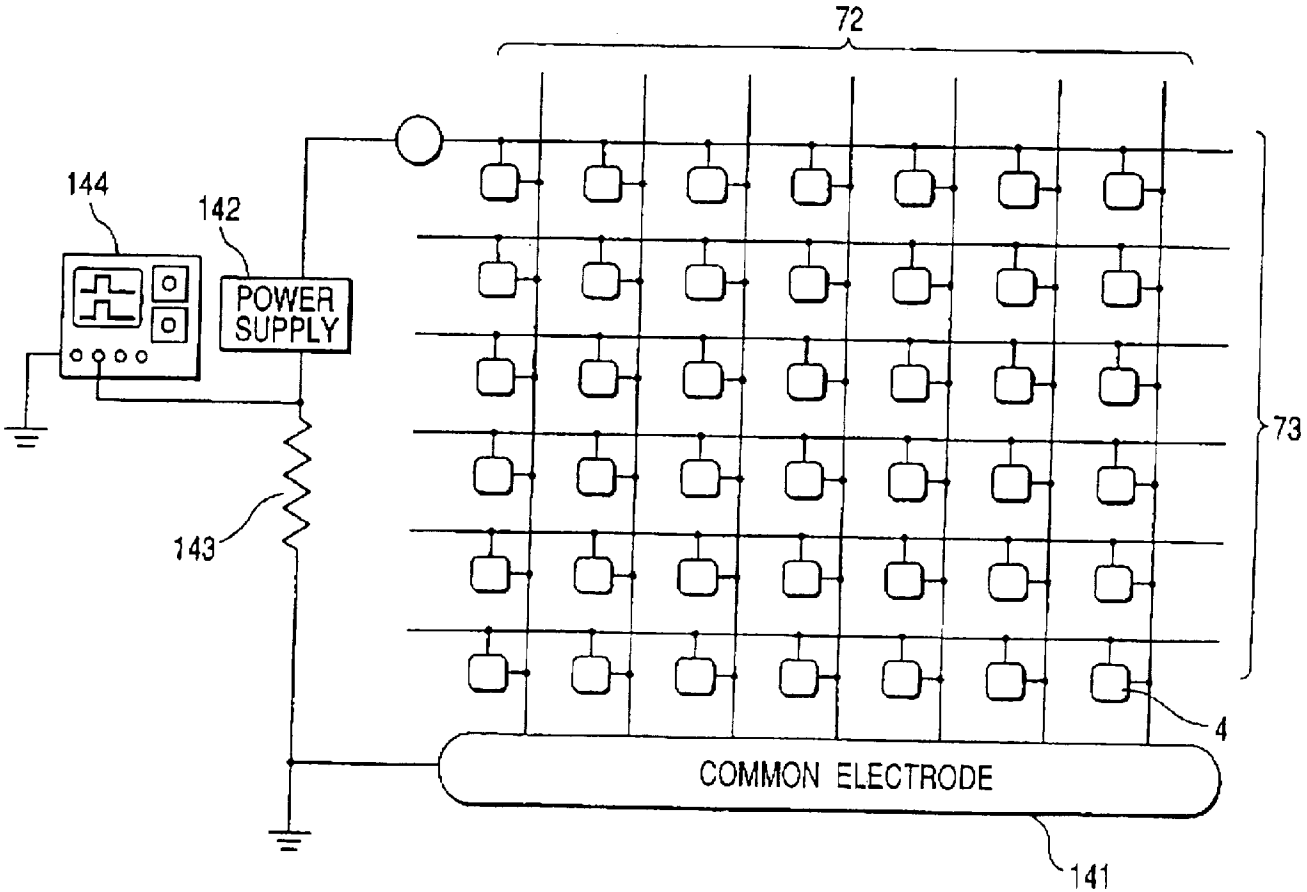
FIG. 10 is a schematic diagram illustrating a wiring method for a forming process and an activation process according to the present invention.

As shown in FIG. 10, a voltage can be applied to all electroconductive films 4 on the electron source substrate by connecting all the column-directional wires 72 in common and sequentially applying (scrolling) phase-shifted pulses to the row-directional wires 73. Reference numeral 143 represents a current measuring resistor, and reference numeral 144 represents a current measuring oscilloscope. The forming process can be executed for each device by the method similar to that described already.

The manufacture method of the present invention is characterized in that the activation process is executed at at least two or more stages. The activation process of depositing carbon or carbon compound in the first gap and its nearby area of the electroconductive films, is realized by decomposing organic substance attached from the atmosphere to the device substrate. If the activation process is to be executed for a number of electron-emitting devices formed on an electron source substrate and the number of devices to which a voltage is applied at the same time in order to shorten the time of the activation process, the amount of organic substance decomposed and consumed on the electron source substrate becomes very large.

The activation process is generally executed at a low partial pressure of organic substance in the atmosphere. It is known that the characteristics of the electron-emitting device formed under such conditions show a small aging change during actual driving and a relatively large electron emission efficiency. If the partial pressure of organic substance in the atmosphere is made large, the amount of organic substance supplied to the substrate increases, although the influence of an insufficient amount can be mitigated, the electron emission efficiency is lowered by excessive deposition of the carbon film.

If the partial pressure of organic substance in the atmosphere is small or if the gas conductance is small such as in the envelope, the amount of substance consumed by the activation process becomes larger than the amount of organic substance supplied to the substrate. Therefore, the concentration of organic substance in the atmosphere may fluctuate or the speed of forming the carbon film may lower.

The present inventors have adopted the two-stage activation process. Namely, the activation process is divided into two stages, at the first stage the process is executed at a high partial pressure of organic substance in the atmosphere, and at the second stage the process is executed at a low partial pressure of organic substance. Therefore, even if the partial pressure of organic substance in the atmosphere is small or even if the gas conductance is small such as in the envelope, a number of devices can be activated in a short time.

It is preferable that the amount of carbon or carbon compound deposited by the first stage process is 70% or more of the final amount of deposited carbon or carbon compound. The reason for this has been made clear from intensive studies of the present inventors. Namely, in order to improve uniformity of the electron emission characteristics, it is necessary to reduce as much as possible the amount of carbon or carbon compound deposited during the final process at the low partial pressure atmosphere after the first process at the high partial pressure atmosphere. The deposition amount of carbon or carbon compound can be measured through determination by Raman spectroscopic analysis or through volume determination such as AFM and STM.

The lowest partial pressure of organic substance required in the first stage process can be determined from the deposition amount of carbon or carbon compound per device necessary for stable electron emission characteristics, the number of devices to be activated at the same time, the activation time, and from the conversion efficiency (reaction efficiency) of converting (reacting) organic substance into deposited (reacted) carbon or carbon compound. This lowest partial pressure is preferably $5\times10^{-4}$ Pa or higher.

It has been found from intensive studies by the present inventors that the partial pressure of organic substance in the second stage process is preferably $5\times10^{-3}$ Pa or lower.

The manufacture method of the invention is characterized in that of the two-stage process, the first stage activation process detects the electrical characteristics such as device current and emission current, and terminates in accordance with this detected evaluation results.

The first stage activation process is executed at the high partial pressure of organic substance in the atmosphere. Therefore, the carbon deposition amount is large and the device current is increased nearly to the final emission current. The second stage activation process is presumed that crystallinity of the carbon film deposited at the first stage activation process is improved by Joule heat generated by the device current and application of emission electrons. This improved crystallinity may result in the improved aging stability of the electron-emitting devices during actual driving.

The deposition speed of the carbon film during the first stage activation process changes depending upon the shape of the first gap formed by the forming process, the temperature distribution of the substrate, and the local partial pressure of organic substance. If a number of electron-emitting devices formed on the electron source substrate are activated, the deposition speed changes with the position in the substrate. It has been found that uniformity of an electron source can be improved by making the deposition amount of carbons films uniform in the first stage activation process.

The electrical characteristics of the electroconductive films to be detected during the first stage activation process may include the device current flowing through the electrodes of each electron-emitting device, the emission current of electrons emitted from the electroconductive films, and the electron emission efficiency (=emission current/device current). If the termination timing of the first stage activation process is set to a time when a reference device current is detected, this reference device current is preferably a current equal to or larger than the current obtained when the second stage activation process is terminated. Alternatively, the termination timing of the first stage activation process may be set to a predetermined time after the time when the termination is determined from the electrical characteristics.

It is known that as the carbon film deposited near the electron-emitting device becomes large, the device current becomes large even if the amount of adsorbed organic substance is large. This current generated by the adsorbed organic substance changes with the partial pressure of organic substance in the atmosphere.

Since the first stage activation process is executed at a higher partial pressure of organic substance in the atmosphere than the second stage activation process, the adsorption and ionization of organic substance contribute largely to the device current. According to the present invention, the first stage activation process is terminated when the reference current equal to or larger than the current value to be obtained when the second stage activation process is terminated. Accordingly, a large amount of organic substance will not be consumed during the second stage activation process, the activation process can be executed in a short time, and the characteristics of the electron source can be made uniform.

The voltage value used when the current is measured may be equal to the voltage applied during the activation process, or may be a lower voltage. Since the partial pressure of organic substance during the first stage activation process is high, if the deposition of the carbon film becomes excessive, the ohmic current increases and the non-linear characteristics of the device current cannot be obtained. Therefore, the termination of the first stage activation process may be determined by detecting the device current at the threshold voltage.

In measuring the current at a voltage smaller than the activation voltage, the voltage waveform to be used for activation may be made stepwise, or a voltage pulse for the evaluation of electrical characteristics may be applied at a predetermined time interval. The characteristics may be measured for each device or for all devices connected via the wires. In the latter case, the total value or an average value is used.

According to the present invention, it is necessary to lower the partial pressure of organic substance in the atmosphere for all devices on the substrate until the second stage activation process starts after the completion of the first stage activation process. The partial pressure of organic substance is generally lowered by reducing the supply amount of organic substance introduced into the vacuum chamber from the gas source of organic substance. The invention is characterized in that a voltage is not applied to all devices on the substrate when the partial pressure of organic substance in the atmosphere is lowered.

If a voltage is applied to the device of the electron source when the partial pressure of organic substance is lowered after the completion of the first stage activation process, a new carbon film is deposited on the carbon film deposited in the first stage activation process because the partial pressure of organic substance when the voltage is applied is high. The excessive deposition of the carbon film may adversely affect the characteristics (particularly, a lowered electron emission efficiency) of the electron-emitting device and may degrade uniformity of devices formed in the second stage activation process.

After the activation process, it is preferable to execute the stabilization process similar to the case of individual devices. To this end, the envelope 164 is heated and maintained at 80 to 250° C. In this state, the inside of the envelope is evacuated via the exhaust pipe 132 by the evacuator 135 such as an ion pump and a sorption pump which does not use oil. After the amount of organic substance in the atmosphere is reduced sufficiently small, the exhaust pipe is heated with a burner and melted and sealed.

In order to retain the pressure in the envelope 164 after sealing it, a gettering operation may be executed. Immediately before or after sealing the envelope 164, a getter at a predetermined position (not shown) in the envelope 164 is heated by resistance heating or RF heating to form a vapor evaporation film. The getter generally contains Ba as its main component. The absorption function of the vapor evaporation film maintains the initial atmosphere in the envelope 164.

According to the present invention, the forming process and activation process may be executed after the envelope is formed, or the envelope may be formed by using an electron source substrate already subjected to the forming and activation processes.

Figure 11:
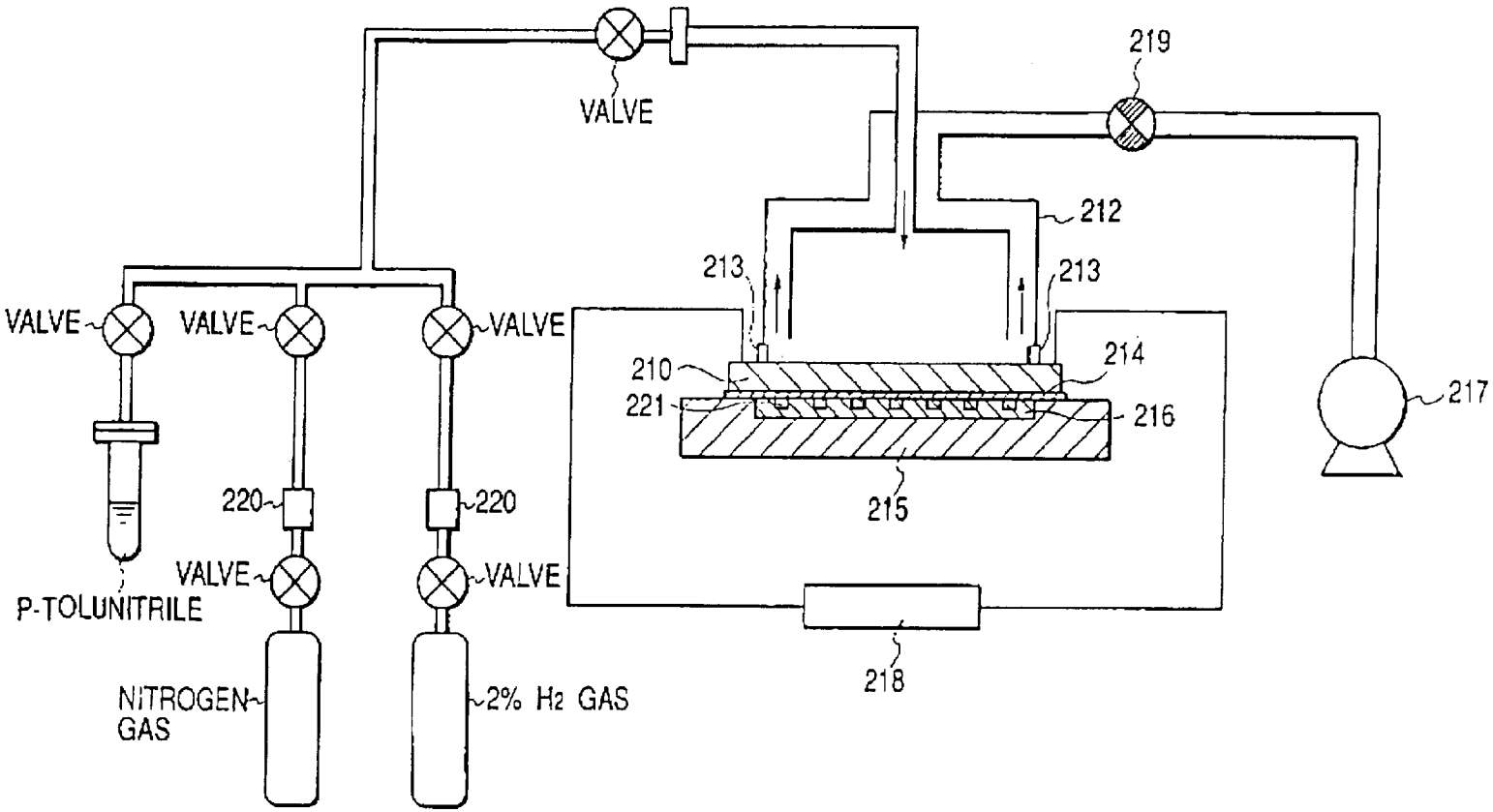
FIG. 11 is a schematic diagram showing another example of a vacuum system used for an activation process according to the present invention.

The forming and activation processes are executed for an electron source substrate, by placing the electron source in a vacuum chamber or by using a system constituted of a substrate stage and a vacuum chamber such as shown in FIG. 11.

A surface area excepting a peripheral area of an electron source substrate 210 on a substrate stage 215 is covered with a vacuum chamber 212. The vacuum chamber 212 is of a hood shape with an inner space. The surface area excepting the peripheral area of the electron source substrate is hermetically sealed from the outer space by an O-ring 213. An electrostatic chuck 216 is mounted on the substrate stage 215 in order to prevent the substrate from being deformed or broken by a pressure difference between the front and bottom surfaces of the electron source substrate while the inside of the vacuum chamber is degassed.

An electrostatic force generated when a voltage is applied between an electrode (not shown) in the electrostatic chuck and the electron source substrate 210 attracts the electron source substrate 210 toward the substrate stage 215 and fixes the substrate to the electrostatic chuck 216. A conductive film such as an ITO film is formed on the back surface of the substrate in order to maintain the electron source substrate 210 at a predetermined potential. In order to attract the substrate by the electrostatic chuck method, it is necessary that the distance between the electrode (not shown) in the electrostatic chuck and the substrate is short. It is therefore desired to push the electron source 210 once toward the electrostatic chuck 216 by another method. In the system shown in FIG. 11, the inside of a groove 221 formed in the surface layer of the electrostatic chuck 216 is degassed to push the electron source substrate 210 against the electrostatic chuck by the atmospheric pressure, and then a high voltage is applied from a high voltage source (not shown) to the electrode (not shown) in the electrostatic chuck. In this manner, the substrate can be attracted and fixed to the electrostatic chuck. Thereafter, the inside of the vacuum chamber 212 is degassed. In this case, the pressure difference between the back and front surfaces of the substrate is cancelled by the electrostatic force generated by the electrostatic chuck so that the substrate can be prevented from being deformed or broken. In order to increase the thermal conductivity between the electrostatic chuck 216 and electron source substrate 210, it is desired to introduce heat exchange gas into the groove 221 after being degassed. The gas is preferably He. Other gasses may also be used with similar effects. By introducing heat exchange gas, not only thermal conduction is possible in the area of the groove 221 between the electron source substrate 210 and electrostatic chuck 216, but also thermal conduction becomes larger in the area where the groove 221 is not formed, as compared to the case wherein the electron source substrate 210 and electrostatic chuck 216 are simply in mechanical contact with each other. Therefore, the total thermal conduction can be improved greatly. Heat generated from the electron source substrate 210 during the processes such as the forming and activation processes can be easily transferred via the electrostatic chuck 216 to the substrate stage 215 Therefore, a temperature rise of the electron source substrate 210 and a temperature distribution resulting from local heat generation can be suppressed. In addition, if the substrate stage 215 is provided with a temperature control means such as a heater and a cooling unit, the temperature of the substrate can be controlled more precisely.

Next, an example of the structure of a driver circuit will be described with reference to FIG. 8. This driver circuit drives a television signal of the NTSC system to display an image on a display panel using a simple matrix electron source. In FIG. 8, reference numeral 101 represents an image display panel, reference numeral 102 represents a scanner circuit, reference numeral 103 represents a control circuit, and reference numeral 104 represents a shift register. Reference numeral 105 represents a line memory, reference numeral 106 represents a sync signal dividing or separating circuit, reference numeral 107 represents a modulation signal generator, and Vx and Va represent d.c. power sources. The display panel 101 is connected to an external circuit via terminals Dox1 to Doxm, terminals Doy1 to Doyn, and a high voltage terminal Hv. A scan signal is applied to the terminals Dox1 to Doxm to sequentially drive the electron source in the display panel, i.e., one row (n devices) of the electron-emitting device group wired in a matrix shape of m rows and n columns.

A modulation signal is applied to the terminals Doy1 to Doyn to control an output electron beam of each device of the electron-emitting devices of one row selected by the scan signal. A d.c. voltage, e.g., 10 kV is supplied from the d.c. voltage source Va to the high voltage terminal. This voltage is an acceleration voltage to supply the electron beam emitted from the electron-emitting device with an energy sufficient for exciting the phosphor. The scanner circuit 102 will be described. The scanner circuit has m switching elements (schematically shown in FIG. 8 at S1 to Sm). Each switching element selects either an output voltage from the d.c. power source Vx or 0 V (ground level) and supplies the selected voltage to the terminal Dox1 to Doxm.

Each of the switching elements S1 to Sm operates in accordance with a control signal T output from the control circuit 103. For example, the switching element is made of a combination of FETs. In this example, the d.c. voltage source Vx is set so that it can output a constant voltage to make the drive voltage of the device not scanned, equal to or lower than the electron emission threshold voltage of the electron-emitting device, based on the characteristic of the electron-emitting device (electron emission threshold).

The control circuit 103 has a function of controlling operation of respective components so as to display a proper image in accordance with externally input image signals. In response to a sync signal Tsync supplied from the sync signal separating circuit 106, the control circuit generates control signals Tscn, Tsft and Tmry and supplies them to corresponding circuits.

The sync signal separating circuit 106 separates an externally input television signal of the NTSC system into sync signals and a luminance signal, and can be made by using general frequency separation (filter) circuits or the like. The sync signals separated by the sync signal separating circuit 106 include a vertical sync signal and a horizontal sync signal. These sync signals are represented collectively by Tsync for the convenience sake. The luminance signal of an image separated from the television signal is represented by a DATA signal. The DATA signal is input to the shift register 104.

The shift register 104 serial-parallel converts a time sequentially and serially input DATA signal for each line of the image, and operates in response to the control signal Tsft supplied from the control circuit 103 (this control signal Tsft may be a shift clock of the shift register 104). Data of one line image (corresponding to drive data for n electron-emitting devices) serial-parallel converted is output from the shift register 104 as n parallel signals Id1 to Idn.

The line memory 105 is a storage device for storing data of one line image during a necessary period, and stores the contents of Id1 to Idn in response to the control signal Tmry supplied from the control circuit 103. The stored contents are input to the modulation signal generator 107 as I'd1 and I'dn.

In response to the image data I'd1 to I'dn, the modulation signal generator 107 generates a signal for properly driving and modulating each of the electron-emitting devices. The output signal is supplied via the terminals Doy1 to Doyn to the electron-emitting devices of the display panel 101.

As a method of modulating the electron-emitting device in accordance with an input signal, a voltage modulation method, a pulse width modulation method or the like may be adopted. If the voltage modulation method is used, the modulation signal generator 107 may be made of a circuit of the voltage modulation type capable of generating a voltage pulse having a constant width and a peak value changing with the input data.

If the pulse width modulation method is used, the modulation signal generator 107 may be made of a circuit of the pulse width modulation type capable of generating a voltage pulse having a constant peak value and a pulse width changing with the input data. The shift register 104 and line memory 105 may be either a digital type or an analog type so long as the serial/parallel conversion and storage of the image signal can be performed at a predetermined speed.

If the digital type is used, it is necessary to digitalize the output signal DATA from the sync signal separating circuit 106. To this end, an A/D converter is provided at the output of the sync signal separating circuit 106. Also, depending upon whether the output signal of the line memory 105 is digital or analog, the circuit used by the modulation signal generator 107 becomes slightly different.

More specifically, in the case of the voltage modulation method using digital signals, the modulation signal generator 107 uses, for example, a D/A converter circuit and an amplifier if necessary. In the case of the pulse width modulation method, the modulation signal generator 107 uses, for example, a high speed oscillator, a counter for counting the wave number of a signal output from the oscillator, and a comparator for comparing the output of the counter with the output of the memory. If necessary, an amplifier is used for voltage-amplifying the modulation signal pulse-width modulated and output from the comparator to a sufficient drive voltage for the electron-emitting device.

In the case of the voltage modulation method using analog signals, the modulation signal generator 107 uses, for example, an amplifier using an operational amplifier, and if necessary, a level shift circuit. In the case of the pulse width modulation method, the modulation signal generator 107 uses, for example, a voltage controlled oscillator (VCO), and if necessary, and an amplifier for voltage-amplifying the modulating signal to a sufficient drive voltage for the electron-emitting device.

In the image-forming apparatus of the invention constructed as above, a voltage is applied to each electron-emitting device via each of the external terminals Dox1 to Doxm and each of the terminals Doy1 to Doyn to emit electrons from each electron-emitting device. A high voltage is applied via the high voltage terminal Hv to the metal back 85 or transparent electrode (not shown) to accelerate the electron beam. The accelerated electrons collide with the fluorescent film 84 to emit light and form an image.

The structure of the image-forming apparatus described above is only illustrative and various modifications are possible without departing from the technical aspects of the invention. The input signal is not limited to those of the NTSC system, but other input signals of different systems can be used, such as the PAL system and the SECAM system as well as those systems using a number of scan lines such as high definition TV system like the MUSE system.

Figure 12:
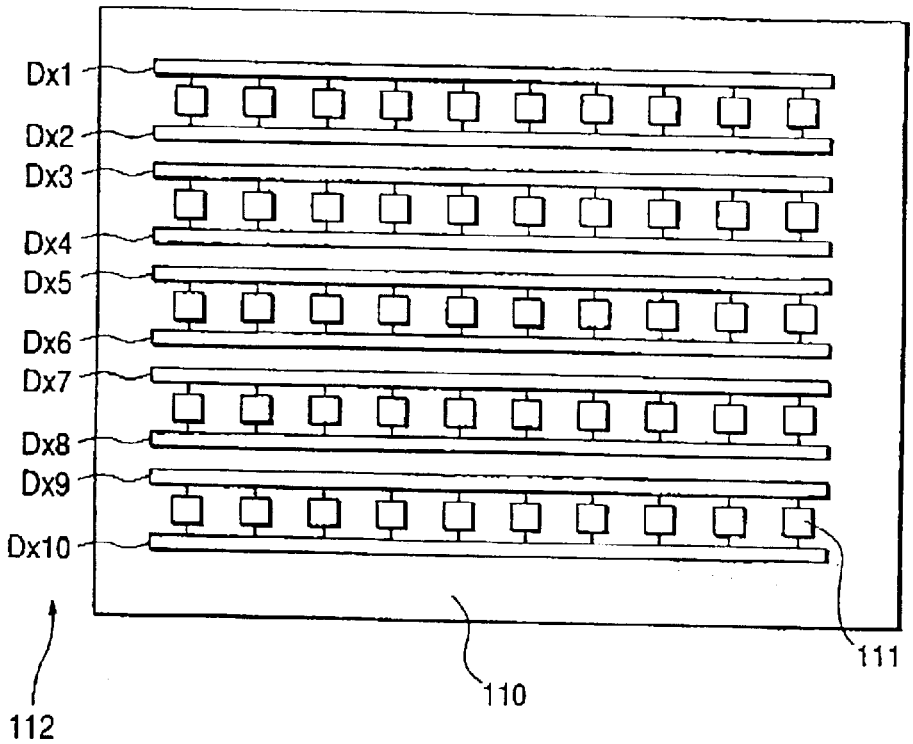
FIG. 12 is a schematic diagram illustrating another wiring method for a plurality of electron-emitting devices.

FIG. 12 is a schematic diagram showing an example of a ladder-like electron source. In FIG. 12, reference numeral 110 represent an electron source substrate, and reference numeral 111 represents an electron-emitting device. Reference numeral 112 represents common wires Dx1 to Dx10 for connecting the electron-emitting devices 111. A plurality of electron-emitting devices 111 are disposed in parallel along the X direction on the substrate 110. Each line in the X direction is called a device row. A plurality of device rows are disposed to constitute an electron source. By applying a drive voltage across the common wires of each device row, the device row can be driven independently. Namely, a voltage equal to or higher than the electron emission threshold value is applied to the device row from which electrons are emitted, whereas a voltage lower than the electron emission threshold value is applied to the device row from which electrons are not emitted. The common wires Dx2 to Dx9 between adjacent device rows may be used in common. For example, the wires Dx2 and Dx3 may be made of a single wire.

Figure 13:
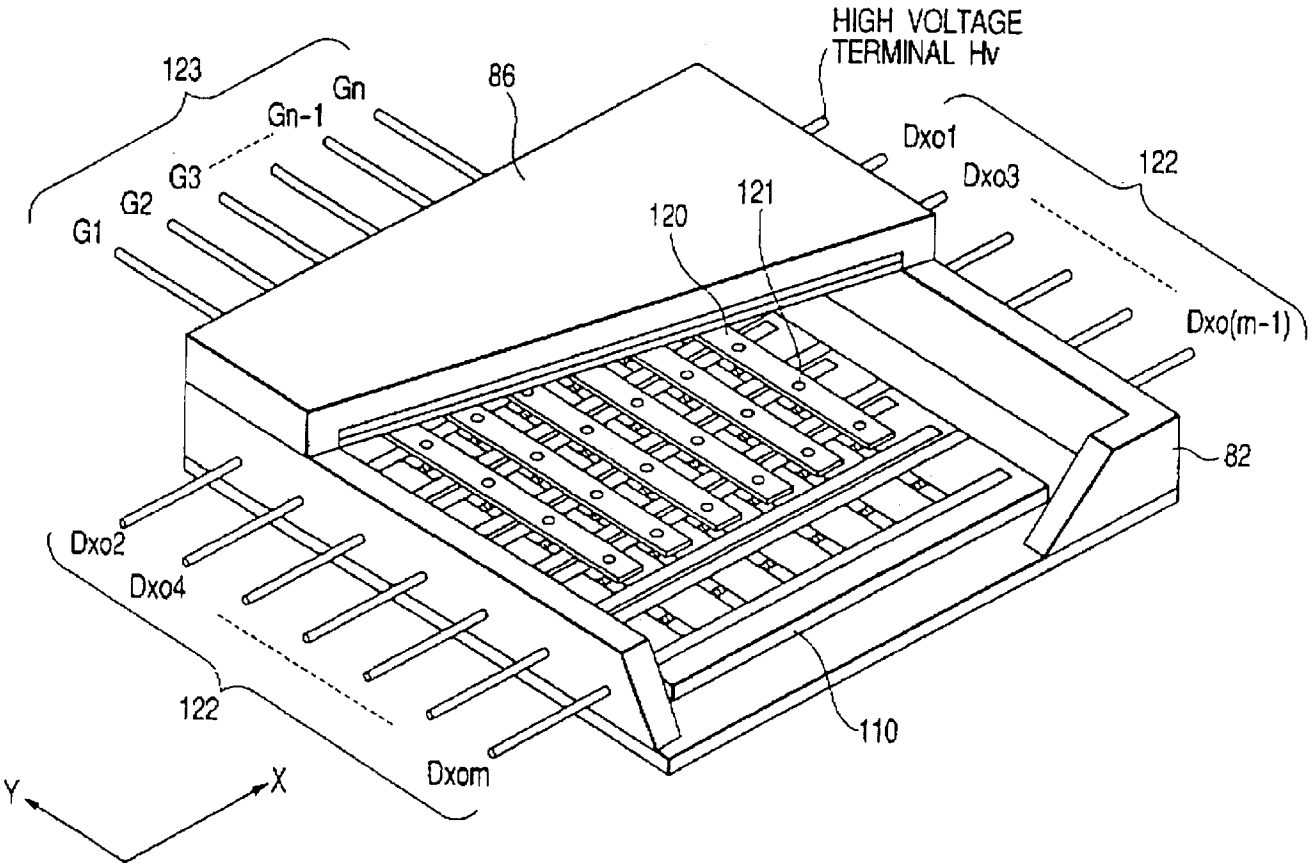
FIG. 13 is a perspective view showing another example of an image-forming apparatus manufactured by a manufacture method according to the present invention.

FIG. 13 is a schematic diagram showing an example of the panel structure of an image-forming apparatus using a ladder-like electron source. Reference numeral 120 represents a grid electrode, reference numeral 121 represents an opening through which electrons pass, and reference numeral 122 represents external terminals Dox1, Dox2, . . . , Doxm. Reference numeral 123 represents external terminals G1, G2, . . . , Gn connected to the grid electrodes 120, and reference numeral 124 represents an electron source substrate having the common wires between adjacent device rows as single wires.

A distinctive difference between the image-forming apparatus shown in FIG. 13 from the simple matrix image-forming apparatus shown in FIG. 6 resides in whether the grid electrodes 120 are used between the electron source substrate 110 and face plate 86.

In FIG. 11, the grid electrodes 120 are provided between the substrate 110 and face plate 86. The grid electrode 120 modulates the electron beam emitted from each electron-emitting device. The grid electrode 120 is a strip electrode perpendicular to the device row in the ladder-like layout and is formed with circular openings 121 corresponding to respective devices through which electron beams pass. The shape and position of the grid electrode are not limited to those shown in FIG. 13. For example, a number of meshed openings may be formed, and the grid electrode may be disposed around or near the emitting device.

The external terminals 122 and grid external terminals 123 are electrically connected to an unrepresented control circuit. In the image-forming apparatus of this example, synchronously with sequentially driving (scanning) the device row one row after another, the modulation signal of the one line image is applied at the same time to the grid electrode column. In this manner, application of each electron beam to the phosphor can be controlled and an image can be displayed one line after another. The image-forming apparatus of the invention may be applied to a television broadcasting display apparatus, a display apparatus for a television conference system and a computer, and to an optical printer constituted of a photosensitive drum and the like.

Embodiments of the electron source, a method of manufacturing an image-forming apparatus according to the present invention will be described in detail with reference to the accompanying drawings.

First Embodiment

Figure 14A:
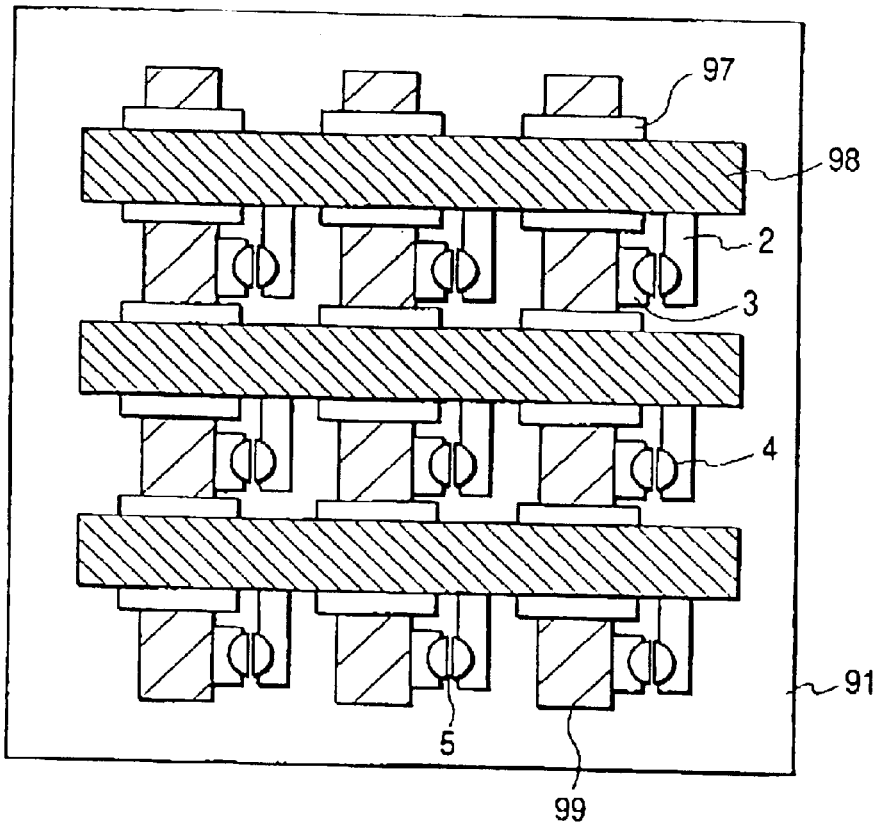
FIGS. 14A and 14B are diagrams partially showing an electron source according to a first embodiment of the invention.
Figure 14B:
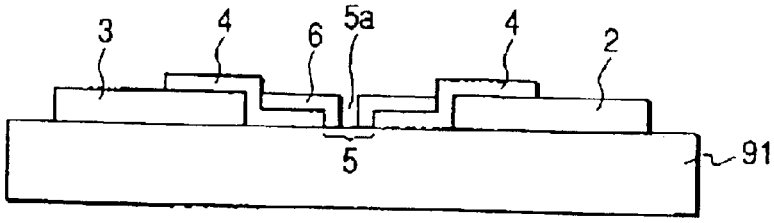

FIG. 14A is a plan view partially showing an electron source of this embodiment. FIG. 14B is a cross sectional view partially showing an electron-emitting device. In FIGS. 14A and 14B, reference numeral 91 represents a substrate, reference numeral 98 represents row-directional wires (200 rows), reference numeral 99 represents column-directional wires (600 columns), reference numeral 4 represents electroconductive films, reference numeral 5 represents a gap between the electroconductive films 4, reference numerals 2 and 3 represent device electrodes, and reference numeral 97 represents interlayer insulating films.

Next, the manufacture method will be described specifically in the order of manufacture processes.

Process-1

On a cleaned soda lime glass substrate 91, plural pairs of device electrodes 2 and 3 were formed by an offset printing method. The distance L between the device electrodes was set to 20 $\mu$m, and the device electrode width W was set to 125 $\mu$m.

Process-2

The column-directional wires 99 were formed by a screen printing method. Next, the interlayer insulating films 97 having a thickness of 0.1 $\mu$m were formed by a screen printing method. The row-directional wires 98 were also printed.

Process-3

Aqueous solution was formed by dissolving polyvinyl alcohol at a weight concentration of 0.05%, 2-propanol at a weight concentration of 15% and ethylene glycol at a weight concentration of 1%. In this solution, tetra mono ethanolamine—palladium acetic acid ($Pd(NH_2CH_2CH_2OH)_4(CH_3COO)_2$) was dissolved at the palladium weight concentration of about 0.15% to obtain yellow solution.

A droplet of this aqueous solution was applied four times to each device electrode and to the area between the device electrodes by using an ink jet apparatus of an ink jet type (an ink jet printer head BC-01 manufactured by CANON Inc.)

Process-4

The specimen formed in Process-3 was baked in the atmospheric air at 350° C. The electroconductive films of a fine particle structure made of PdO was therefore formed between each of plural pairs of device electrodes 2 and 3. With the above processes, a plurality of electroconductive films 4 wired in a matrix shape by the plurality of row-directional wires 98 and column-directional wires 99 were formed on the substrate 91 as shown in FIG. 15.

Figure 15:
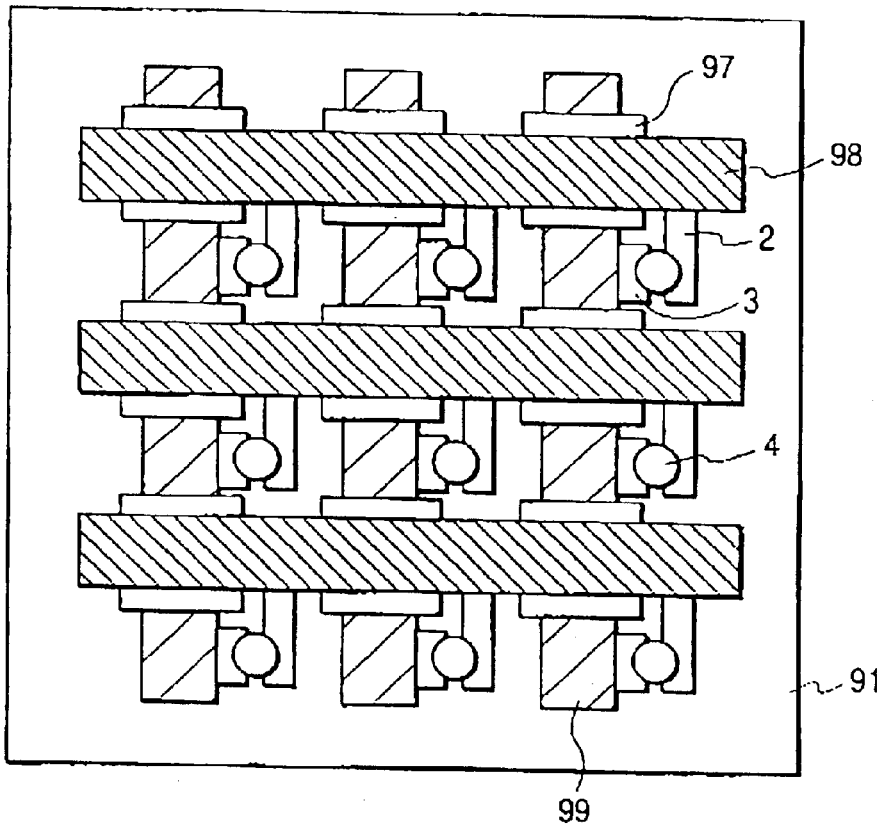
FIG. 15 is a diagram partially showing an electron source substrate before the forming process according to the first embodiment of the invention.
Figure 16:
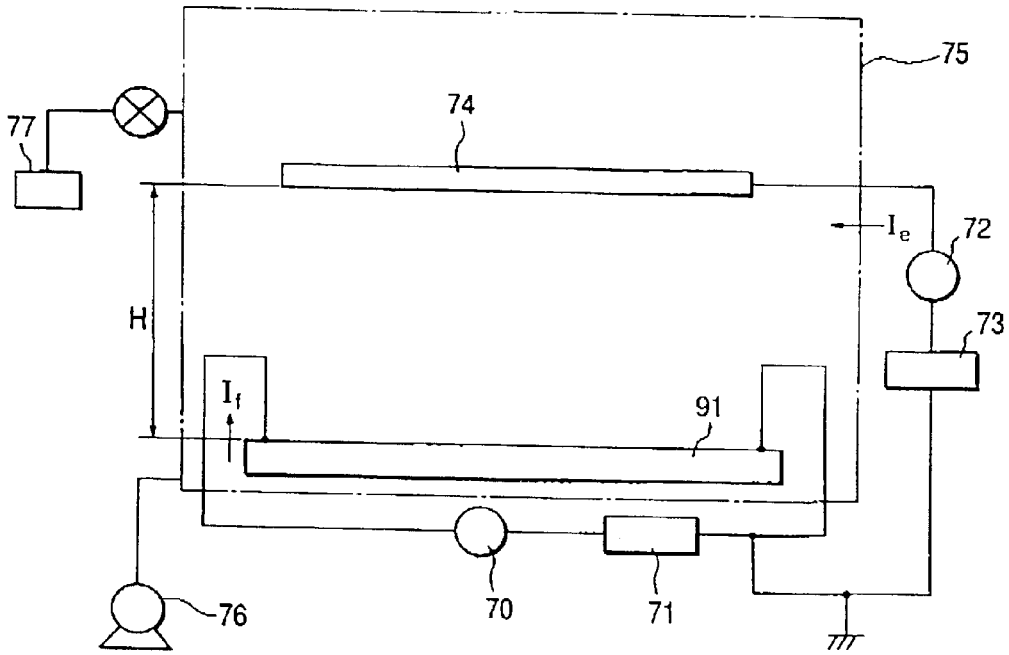
FIG. 16 is a schematic diagram of a vacuum system used by the first embodiment.

Next, the substrate 91 shown in FIG. 15 subjected to Process-4 was placed in a vacuum processing apparatus shown in FIG. 16. The inside of the vacuum processing apparatus was evacuated by a vacuum pump to a vacuum degree of $10^{-5}$ Pa.

The vacuum processing apparatus shown in FIG. 16 will be described. FIG. 16 is a schematic diagram showing an example of the vacuum processing apparatus. By using this vacuum processing apparatus, not only the forming, activation and stabilization processes can be executed, but also this apparatus provides a function as a measurement evaluation apparatus. For the simplicity of the drawing, the row-directional wires 98, column-directional wires 99, interlayer insulating films 97, device electrodes 2 and 3, and electroconductive films 4 are all omitted.

In FIG. 16, reference numeral 75 represents a vacuum chamber, and reference numeral 76 represents an evacuator pump. Reference numeral 71 represents a power source for applying a voltage Vf to the electroconductive films 4, reference numeral 70 represents an ammeter for measuring the device current If flowing through the electroconductive films 4 between the device electrodes 2 and 3, and reference numeral 74 represents an anode electrode for capturing the emission current Ie emitted from the electron-emitting region formed in the electroconductive films 4. Reference numeral 73 represents a high voltage source for applying a voltage to the anode electrode 74, and reference numeral 72 represents an ammeter for measuring the emission current emitted from the electron-emitting region formed in the electroconductive films. For example, by setting the voltage at the anode electrode in a range from 1 kV to 10 kV, measurements can be performed by setting the distance H between the anode electrode 74 and substrate 91 in a range from 2 mm to 8 mm. Reference numeral 77 represents an organic gas source used for the activation process.

In the vacuum chamber 75, an apparatus such as a vacuum meter necessary for the measurements in a vacuum atmosphere are mounted to allow measurements and evaluations in a desired vacuum atmosphere. The evacuator pump 76 was structured by an ultra high vacuum system constituted of a turbo pump, a dry pump, an ion pump and the like. The entire vacuum processing apparatus in which the electron source substrate is placed can be heated by an unrepresented heater to 350° C.

Process-5

Next, the forming process was executed in the vacuum processing apparatus shown in FIG. 16. After the inside of the vacuum chamber 75 was degassed to $10^{-5}$ Pa, a voltage was applied to each of the electroconductive films 4 via each of the row-directional wires 98 and each of the column-directional wires 99 on the substrate 91 to execute the forming process. The voltage was applied to each line (row-directional wire). As the voltage was applied, fissures were formed in each electroconductive film 4. The voltage used for the energization forming was a rectangular pulse voltage whose peak value was increased from 0 V at 0.1 V step. The pulse voltage had a pulse width of 1 msec and a pulse interval of 10 msec. The timing of termination of the energization forming process was set to the time when the resistance value of the electroconductive film reached 1 MΩ or larger.

Figure 17:
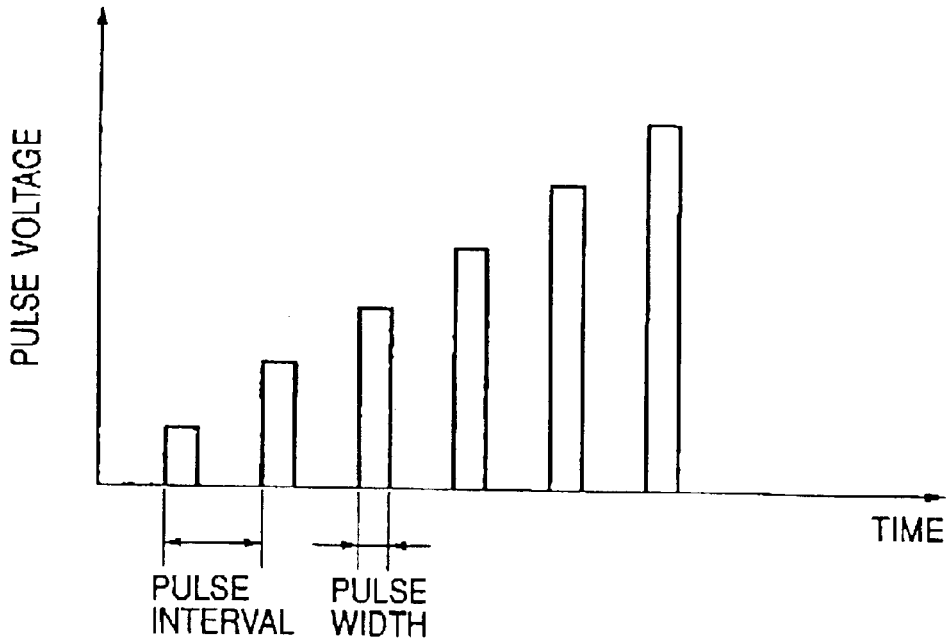
FIG. 17 is a diagram showing the waveforms of a forming voltage used by the first embodiment.

FIG. 17 shows the forming waveform used by the embodiment. The voltage was applied in such a manner that one of the device electrodes 2 and 3 was set to a low potential and the other was set to a high potential.

Process-6

After the inside of the vacuum chamber was degassed to $10^{-5}$ Pa, tolunitrile was introduced to the partial pressure of $1\times10^{-2}$ Pa and a voltage was applied to each of the electroconductive films 4 via corresponding ones of the row-directional wires 98 and column-directional wires 99 on the substrate 91 to execute the first stage activation process. The voltage was applied to each line (row-directional wire) through line sequential scanning. The voltage used for the first stage activation process was a rectangular pulse voltage having a fixed peak value of 15 V, a pulse width of 1 msec and a pulse interval of 10 msec. The voltage was applied to each line (row-directional wire) for 1 minute. With these operations, the first stage activation process was terminated.

As the second stage activation process, the partial pressure of tolunitrile was lowered to $1\times10^{-4}$ Pa by the evacuator, and a voltage was applied to each line (row-directional wire) for 10 minutes similar to the first stage activation process. The second stage activation process was terminated when the average device current of each line became 15 mA.

Figure 18:
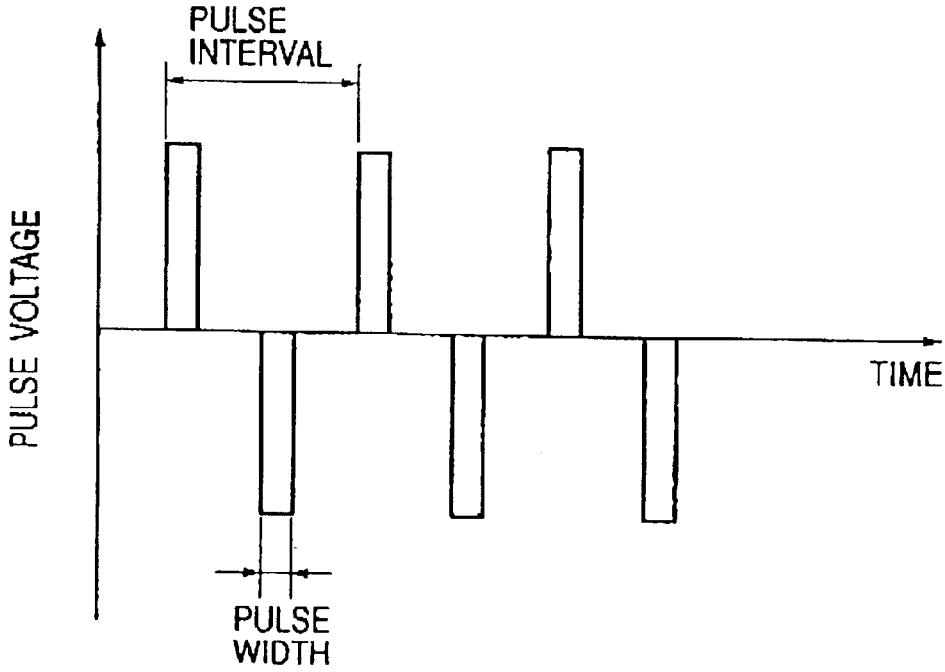
FIG. 18 is a diagram showing the waveforms of an activation voltage used by the first embodiment.

FIG. 18 shows the pulse waveforms used by the activation processes of the first and second stages. In this embodiment, the voltage was applied in such a manner that high and low potentials are alternately applied to the device electrodes 2 and 3 at the pulse interval.

Figure 19:
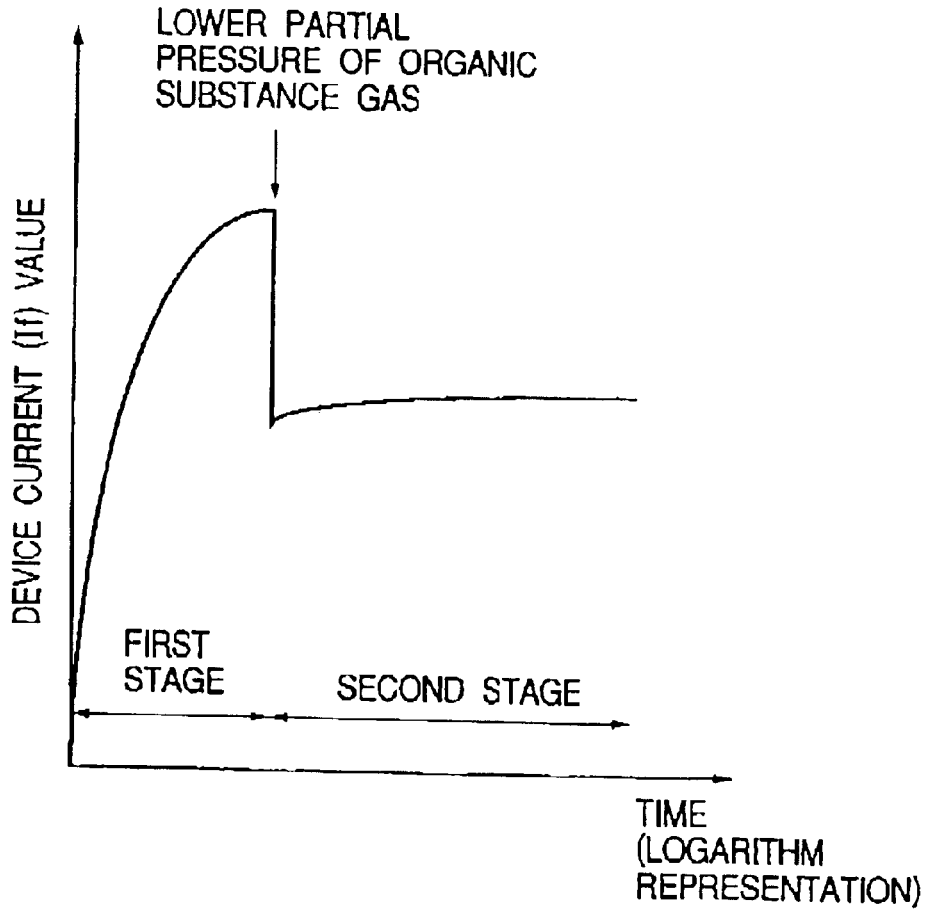
FIG. 19 is a graph showing an increase in a device current during the activation process by the first embodiment.

FIG. 19 shows the aging change in the device current during the activation process of this embodiment. As seen from the graph of FIG. 19, the device current increases considerably during the first stage activation process, whereas the device current increases less during the second stage activation process.

Carbon or carbon compound deposited on each electroconductive film 4 was analyzed by Raman spectroscopy (laser wavelength: 514.5 nm, spot diameter: about 1 μm) when the first stage activation process was terminated and when the second stage activation was terminated. From the measured integration intensities of peaks near at 1580 $cm^{-1}$ and 1335 $cm^{-1}$, it was confirmed that the deposition amount of carbon or carbon compound during the first stage activation process was 85% of that during the second stage activation process.

With the above processes, the carbon film 4*a* was formed on each electroconductive film 4 such as shown in FIGS. 1A and 1B.

Process-7

Next, the stabilization process was executed. The stabilization process is a process of stabilizing the device current If and emission current Ie by degassing organic substance gas in the atmosphere of the vacuum chamber and suppressing carbon or carbon compound from being further deposited on each electroconductive film 4. The entire vacuum chamber was heated to 250° C. to drain organic substance molecules attached to the inner wall of the vacuum chamber and to the substrate 91. At this time, the vacuum degree was set to 1×10 Pa.

With the above processes, the electron source of this embodiment such as shown in FIGS. 14A and 14B was formed.

At this vacuum degree, the characteristics of each electron-emitting device were measured. The average device current If was 1.5 mA and the average emission current Ie was 2 μA. In order to evaluate uniformity of the characteristics, a dispersion value divided by an average value of the characteristics of respective electron-emitting devices was calculated. This dispersion value was 15% for the device current If and 20% for the emission current Ie.

COMPARATIVE EXAMPLE

The substrate 91 subjected to Processes up to Process-5 of the first embodiment was subjected to the activation process of Process-6 of the first embodiment under the following conditions. Tolunitrile was introduced to the partial pressure of $1\times10^{-4}$ Pa and a voltage was applied to each of the electroconductive films 4 via corresponding ones of the row-directional wires 98 and column-directional wires 99 on the substrate 91. The voltage was applied to each line (row-directional wire) through line sequential scanning. The voltage used for the first stage activation process was a rectangular pulse voltage having a fixed peak value of 15 V, a pulse width of 1 msec and a pulse interval of 10 msec. The voltage was applied to each line (row-directional wire) for 60 minutes. The second stage activation process was not executed. With these operations, an electron source of the comparative example was manufactured similar to the first embodiment. Similar to the first embodiment, in order to evaluate uniformity of the characteristics, a dispersion value divided by an average value of the characteristics of respective electron-emitting devices was calculated. This dispersion value was 25% for the device current If and 30% for the emission current Ie.

Second Embodiment

Figure 20:
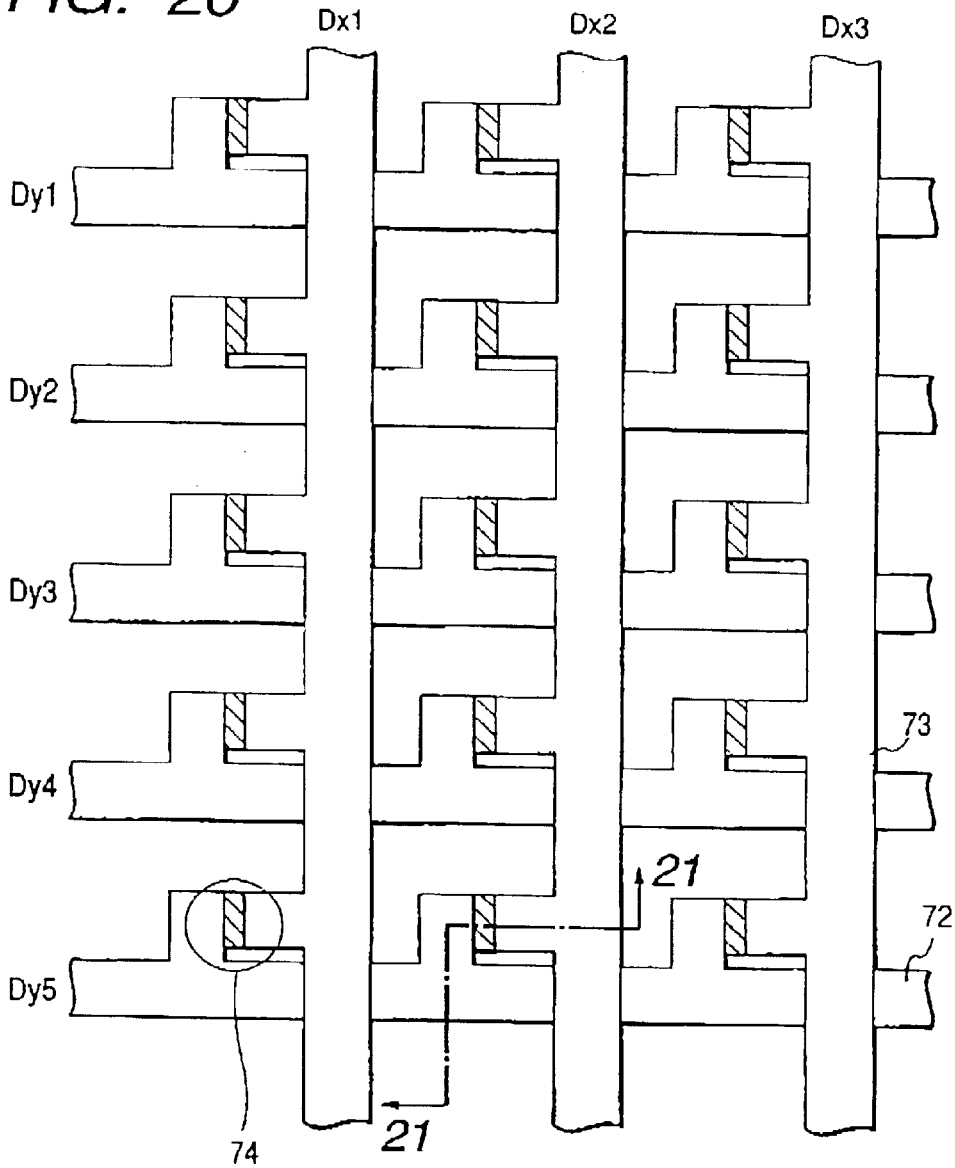
FIG. 20 is a partial view of an electron source according to a second embodiment of the invention.
Figure 21:
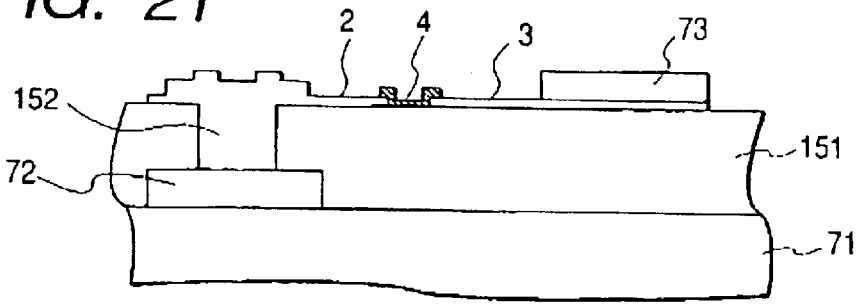
FIG. 21 is a partial cross sectional view of the electron source shown in FIG. 20.

In this embodiment, an image-forming apparatus used for image display will be described. The fundamental structure of the image-forming apparatus of this embodiment is shown in FIG. 6. The fluorescent film of this embodiment is shown in FIG. 7A FIG. 20 is a partial plan view of the electron source of this embodiment. FIG. 21 is a cross sectional view taken along line 21—21 in FIG. 20. In FIGS. 20 and 21, similar elements are represented by using identical reference numerals. Reference numeral 71 represents a substrate, reference numeral 72 represents a column-directional wire (also called a lower wire) connected to the terminal Doyn shown in FIG. 6, reference numeral 73 represents a row-directional wire (also called an upper wire) connected to the terminal Doxm shown in FIG. 6, reference numeral 4 represents a thin film including an electron-emitting region, reference numerals 2 and 3 represent device electrodes, reference numeral 151 represents an interlayer insulating film, and reference numeral 152 represents a contact hole via which the device electrode 2 and lower wire 72 are electrically connected.

The electron source of this embodiment has 600 electron-emitting elements along each row-directional wire and 200 electron-emitting elements along each column-directional wires. Next, the manufacture method will be specifically described in the order of processes, with reference to FIGS. 22A to 22G.

Process-a

Figure 22A:
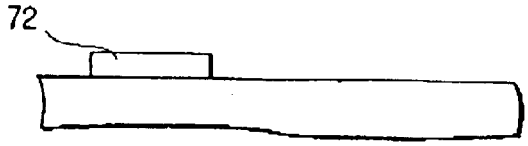
FIGS. 22A, 22B, 22C, 22D, 22E, 22F and 22G are diagrams illustrating the manufacture processes for the electron source according to the second embodiment.

On a soda lime glass (2.8 mm thick), a silicon oxide film was deposited to a thickness of 0.5 mm by sputtering. This soda lime glass was used as a substrate 71. On this substrate 71, Cr and Au were deposited in this order to thicknesses of 5 nm and 600 nm by vacuum evaporation. Thereafter, photoresist (AZ 1370, manufactured by Hoechst Aktiengesellschaft) was spin-coated by using a spinner and baked. Thereafter, a photomask image was exposed and developed to form resist patterns for the lower wires 72. Next, the Au/Cr lamination film was wet etched and removed to form the lower wires 72 having desired patterns (FIG. 22A).

Process-b

Figure 22B:
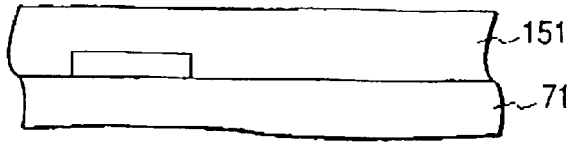
Figure 22C:
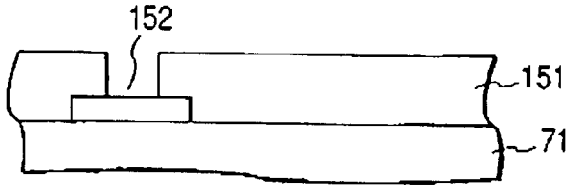

Next, a silicon oxide film was deposited to a thickness of 1.0 mm by RF sputtering to form an interlayer insulating film 151 (FIG. 22B)

Process-c

A photoresist pattern was formed in order to form a contact hole 152 through the silicon oxide film deposited in Process-b. By using the photoresist pattern as a mask, the interlayer insulating film 151 was etched to form the contact hole (FIG. 222C). This etching was performed by RIE (Reactive Ion Etching) using gas of $CF_4$ and $H_2$.

Process-d

Figure 22D:
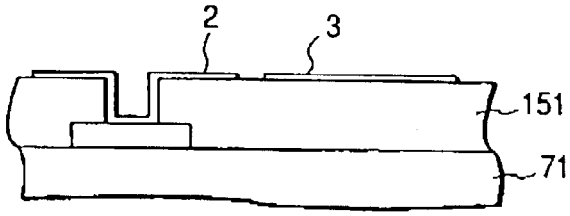

Next, a resist pattern corresponding to a gap G between the device electrodes 2 and 3 was formed by using photoresist (RD-2000N-41, manufactured by Hitachi Kassei CO., Ltd.), and Ti and Ni were deposited in this order to the thicknesses of 5 nm and 100 nm by vacuum evaporation. Next, the photoresist pattern was removed by using an organic solvent, and the electrodes 2 and 3 having desired patterns were formed through lift-off. The distance L1 between the electrodes 2 and 3 was set to 5 mm and the device electrode width W1 was set to 300 mm (FIG. 22D).

Process-e

Figure 22E:
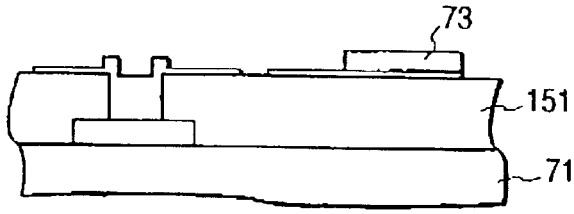

A photoresist pattern for the upper wires 73 was formed on the device electrodes 3, and then Ti and Au were deposited in this order to the thicknesses of 5 nm and 500 nm by vacuum evaporation. Next, by removing unnecessary portions through lift-off, the upper wires 73 having desired shapes were formed (FIG. 22E).

Process-f

Figure 22F:
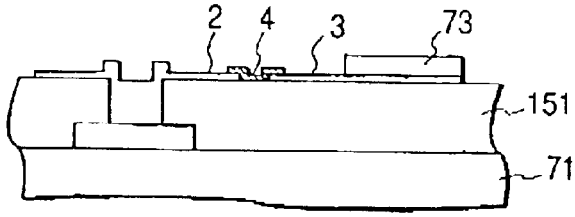

A Cr film having a thickness of 100 nm was deposited by vacuum evaporation and patterned. On this Cr film, organic Pd (ccp 4230, manufactured by Okuno Pharmaceutical K. K.) was spin-coated by using a spinner. Thereafter, heat treatment was executed for 10 minutes at 300° C. An electroconductive film 4 made of PdO fine particles was therefore formed. This film 4 had a thickness of 10 nm and a sheet resistance of $5\times10^4$ Ω/□. Thereafter, the Cr film 153 and the baked electroconductive film 4 were etched by acid etchant to form a desired pattern (FIG. 22F).

Process-g

Figure 22G:
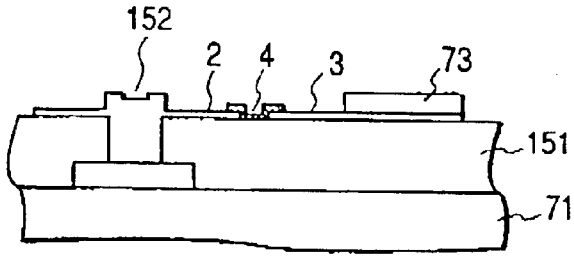

A photoresist pattern having an opening corresponding to the contact hole 152 was formed, and Ti and Au were deposited in this order to thicknesses of 5 nm and 500 nm by vacuum evaporation. By removing unnecessary portions through lift-off, the contact hole 152 was buried (FIG. 22G).

The above processes formed on the insulating substrate 71 a plurality of column-directional wires (lower wires) 72, a plurality of row-directional wires (upper wires) 73, interlayer insulating films 151 insulating the upper wires from the lower wires, and a plurality of electroconductive films 4 matrix-wired via the device electrodes 2 and 3 by the upper and lower wires.

Figure 23:
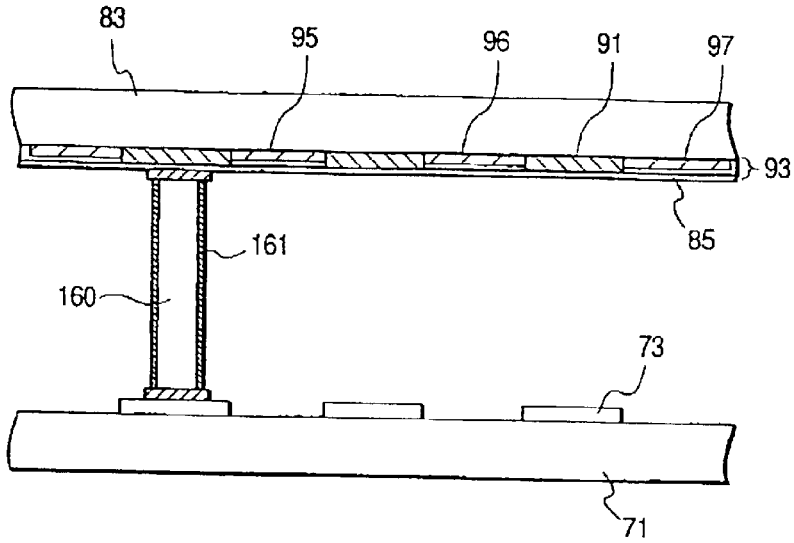
FIG. 23 is a partial cross sectional view of an image-forming apparatus according to the second embodiment of the invention.

A display apparatus using the electron source substrate formed as above will be described with reference to FIGS. 6 and 23.

Conductive frit paste was coated on the upper wire 73 on an electron source substrate 71 by a dispenser, and one end of a spacer 160 was placed on the upper wire 73. In this state, baking was performed to make the spacer stand on the electron source substrate. Next, conductive frit paste was coated on the other end of the spacer 160. The spacer 160 was aligned with the black color conductive member (black stripe) of the face plate 85, and the support frame was coated with frit glass. In this state, baking was performed for 10 minutes at 420° C. to form the envelope 164. In FIG. 6, reference numeral 74 represents an electron-emitting element to be formed by the succeeding processes, reference numerals 72 and 73 represent column- and row-directional wires. FIG. 23 is a schematic diagram showing the cross section of the envelope as viewed along the column wire direction.

Conductive frit paste was used for fixing together the spacer 160, upper wire and face plate 86. The conductive frit paste contains fillers of soda lime glass balls whose surfaces are Au plated. The average diameter of the soda lime glass balls was about 8 $\mu$m. For forming a conductive film on the surface of the filler, electroless plating was used and a Ni film was formed on the underlie to a thickness of about 0.1 $\mu$m, and an Au film was formed on the Ni film to a thickness of about 0.04 $\mu$m. These conductive fillers were mixed with frit glass powder at 30 weight %, and binder was added to prepare the conductive frit paste.

The spacer was made of soda lime glass etched to a width of 0.6 mm, a length of 75 mm, and a height of 4 mm. A semi-electroconductive film 161 made of a nickel oxide film was formed on the spacer 160. The nickel oxide film was formed by using a sputtering system under the conditions of a target of nickel oxide and an atmosphere of mixture of argon and oxygen. The substrate temperature was set to 250° C. during sputtering.

Two juxtaposed spacers were disposed on one upper wire. The spacer was disposed every tenth line so that the pixel area was divided into ten regions in the upper wire direction by the spacers 160.

The fluorescent film 93 on the face plate was made of color phosphors 95, 96 and 97 and black color electroconductive members 91 of the black stripe layout. First, the black stripes were formed, and then each color phosphor was coated between the black stripes to form the fluorescent film 93. The phosphor was coated on the glass substrate by a slurry method. The metal back 85 was formed on the inner surface of the fluorescent film 93. After the fluorescent film was formed, a process (generally called filming) of smoothing the inner surface of the fluorescent film was performed and then Al was vacuum deposited to form the metal back 85. When the envelope is sealed, precise position alignment was performed in order to make each electron-emitting device face the corresponding color phosphor of a color display. Opposite ends of the upper wires and ends of the lower wires on the electron source substrate were electrically connected to an external power source (not shown).

The completed envelope 164 was coupled via an air exhaust pipe to the vacuum system shown in FIG. 9 and degassed by a magnetically floating type turbo molecular pump. The forming process and succeeding processes were performed as in the following.

After the inside of the envelope was degassed to $10^{-2}$ Pa, a rectangular pulse having a pulse width of 1 msec was sequentially supplied from an external power source to the upper wires at a scroll frequency of 4.2 Hz. The peak value of the rectangular pulse was set to 12 V. The lower wires were grounded. A mixture gas of hydrogen and nitrogen (hydrogen 2%, nitrogen 98%) was introduced into the inside of the chamber 133 of the vacuum system, and the pressure was maintained at 1000 Pa. The flow of the gas was controlled by the mass controller 139, and the drain amount from the chamber 133 was controlled by the evacuator 135 and a flow control conductance valve.

After the energization forming process was performed for 10 minutes, the current flowing through the electroconductive film became nearly zero. At this time, the voltage application was stopped and the mixture gas of hydrogen and nitrogen in the chamber 133 was exhausted to complete the forming process. Fissures were formed in a plurality of electroconductive films on the substrate 71 to thus form electron-emitting regions.

Next, the activation process was executed by the following first and second stages.

<First Stage Activation Process>

Figure 24:
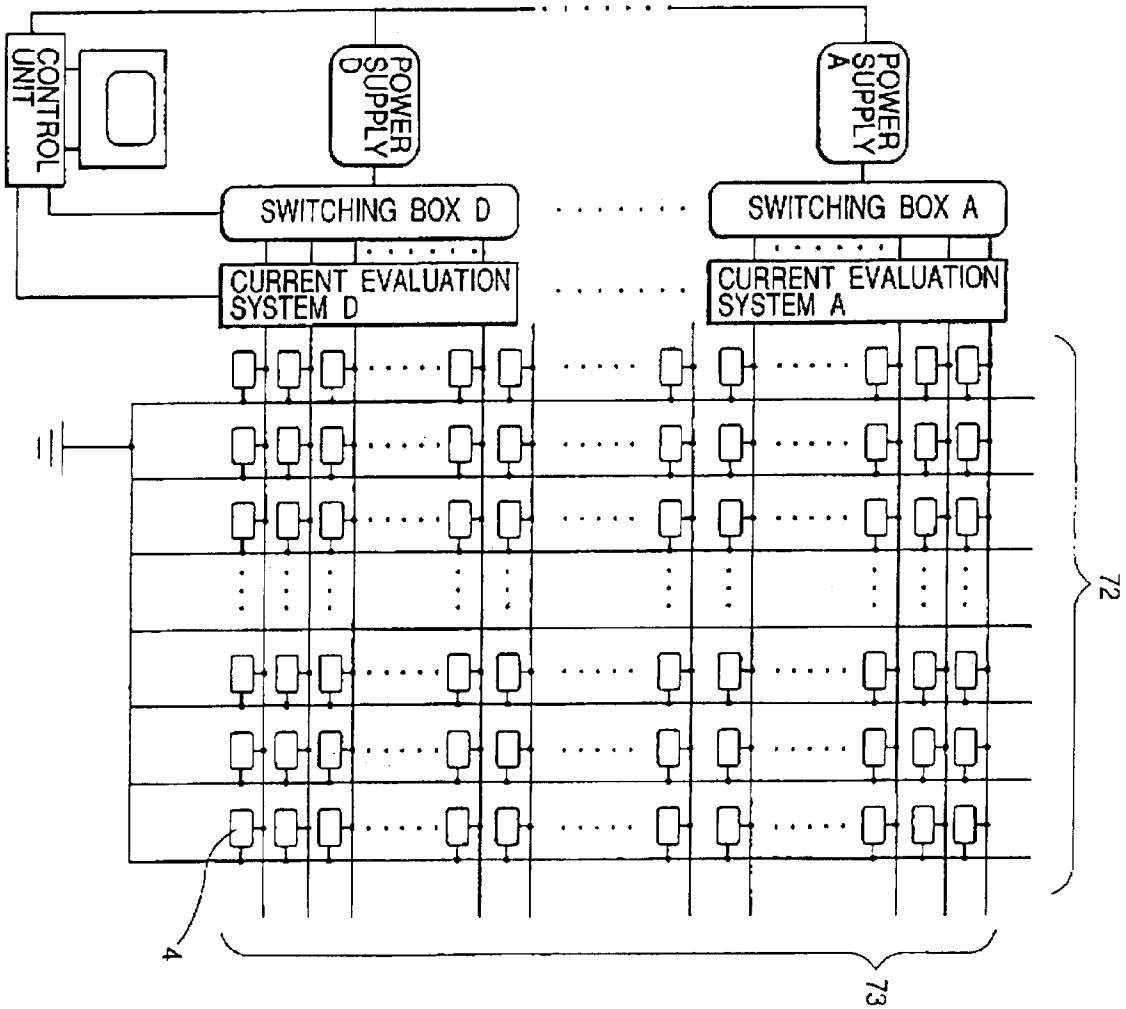
FIG. 24 is a schematic diagram illustrating a wiring method for the activation process according to the second embodiment.

Benzonitrile was introduced via the vacuum chamber 133 of the vacuum system into the envelope 164 to a pressure of $6.6\times10^{-2}$ Pa. FIG. 24 is a diagram showing a connection between external terminals of the envelope and power sources for supplying a voltage for the activation process. External terminals Doy1 to Doyn (n=600) were grounded in common.

External terminals Dox1 to Dox50, external terminals Dox51 to Dox100, external terminals Dox101 to Dox150, and external terminals Dox151 to Dox200 were connected via respective switching boxes A, B, C and D to power sources A, B, C and D. Current evaluation systems A, B, C and D each constituted of an ammeter for measuring current flowing through each wire were connected between the switching boxes and external terminals.

The power sources A to D were controlled by control signals supplied from a control unit to align the phases of activation waveforms. The switching boxes and corresponding power sources were synchronized in operation. In each line block of 50 lines including a block of Dox1 to Dox50, a block of Dox51 to Dox100, a block of Dox101 to Dox150, and a block of Dox151 to Dox200, 10 lines were selected and a voltage was applied time divisionally (in a scroll manner) to 10 lines.

A voltage was therefore applied at the same time to four upper wires on the electron source substrate in the envelope so that the first activation process was executed for the electroconductive films 4 connected to the upper wires. The voltage for the activation process was a rectangular pulse of both polarities having a peak value of ±14 V, a pulse width of 1 msec, and a pulse interval of 10 msec (FIG. 4B).

While ten lines are scrolled, the current flowing through each upper wire was measured by the current evaluation system. When the current exceeded 1 A, the switching box was controlled to terminate the voltage application to the upper wire. This process was repeated five times to activate all the electroconductive films 4.

<Second Stage Activation Process>

The pressure of benzonitrile in the envelope 164 was lowered to $6.6\times10^{-4}$ Pa. Similar to the first stage activation process, a voltage was time divisionally applied to ten lines and across the electrodes 2 and 3 connected to the corresponding conductive film 4 to execute the second stage activation process. The voltage for this activation process was similar to the first stage activation process. The activation time was 30 minutes for each of the electroconductive films 4. The device current flowing through the wire when the process was terminated was in a range from 800 mA to 1 A.

The carbon films 4*a* such as shown in FIGS. 1A and 1B were therefore formed on each electroconductive film 4.

Lastly, the stabilization process was executed by performing a baking process for 10 hours at 150° C. at a pressure of about $1.33\times10^{-4}$ Pa and thereafter, the exhaust pipe was heated with a gas burner to melt and seal the envelope 164.

An image was displayed on the image-forming apparatus of this embodiment completed as above. Namely, scan and modulation signals were applied from an unrepresented signal generator to each electron-emitting device via the external terminals Dox1 to Doxm (m=200) and Doy1 to Doyn (n=600). A high voltage of 6 kV was also applied via the high voltage terminal Hv to the metal back 85 to accelerate electrons emitted from each electron-emitting device. The electrons collided with the fluorescent film 93 which was excited and emitted light to form an image.

Pulse voltages were applied to the row-directional wires and column-directional wires to measure a variation in the electron emission characteristics (device current If and emission current Ie) of each electron-emitting device of the image-forming apparatus. A variation was 11% for If and 15% for Ie. This variation value is a dispersion value divided by an average of If and Ie of respective devices.

Third Embodiment

The device current was not evaluated during the first stage activation process of the second embodiment, and the activation time was set to 1 minute for all lines. The other conditions were similar to the second embodiment. A variation in the electron emission characteristics (If and Ie) of each electron-emitting device of this image-forming apparatus was measured. A variation was 15% for If and 20% for Ie.

Fourth Embodiment

Figure 25:
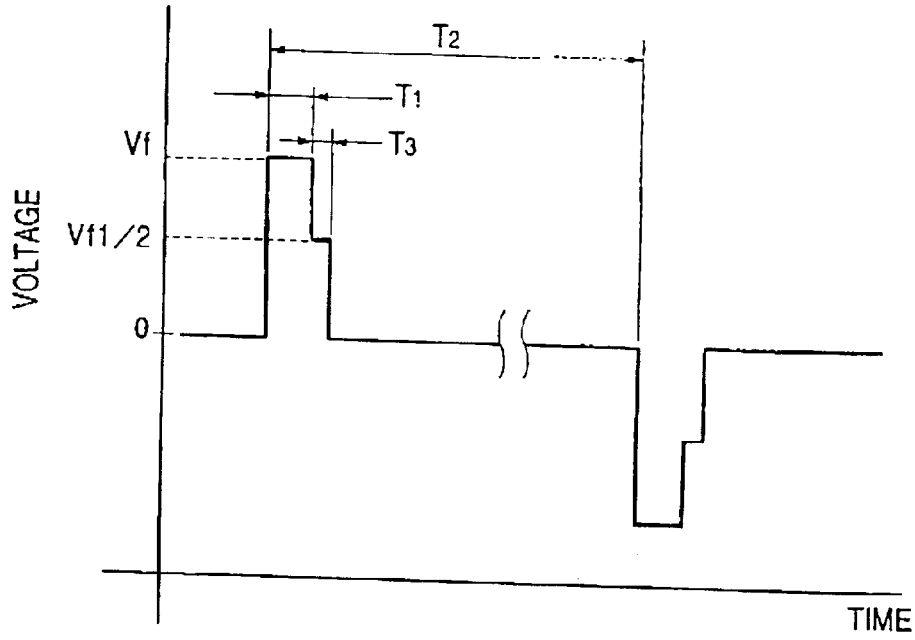
FIG. 25 is a diagram showing the waveforms of an activation voltage used by a fourth embodiment.

The voltage for the first stage activation process had the waveforms shown in FIG. 25. The first stage activation process was executed while the device current (If ½) was measured at a half voltage (vf ½) of the activation voltage. The other conditions were similar to the second embodiment. In FIG. 25, T1 was set to 10 msec, T2 was set to 0.9 msec, and T3 was set to 0.1 msec. When (If ½) of each line exceeded 0.6 mA, the voltage application to each line was stopped. A variation in the electron emission characteristics (If and Ie) of each electron-emitting device of this image-forming apparatus was measured. A variation was 9% for If and 11% for Ie.

Fifth Embodiment

The first stage activation process was terminated when the current flowing through the upper wire exceeded 600 mA during the first stage activation process of the second embodiment. The second stage activation process and succeeding processes were similar to the first embodiment. The device current flowing through the upper wire when the second stage activation process was terminated was in a range from 350 mA to 500 mA. A variation in the electron emission characteristics (If and Ie) of each electron-emitting device of this image-forming apparatus was measured. A variation was 25% for If and 30% for Ie. The second stage activation process was executed for a longer time. It took about 2.5 hours until the device current reached about 600 mA.

Sixth Embodiment

In the sixth embodiment, the first stage activation process was executed by evaluating the device current flowing through each electroconductive film. The processes up to the forming process were similar to the second embodiment.

<First Stage Activation Process>

Figure 26:
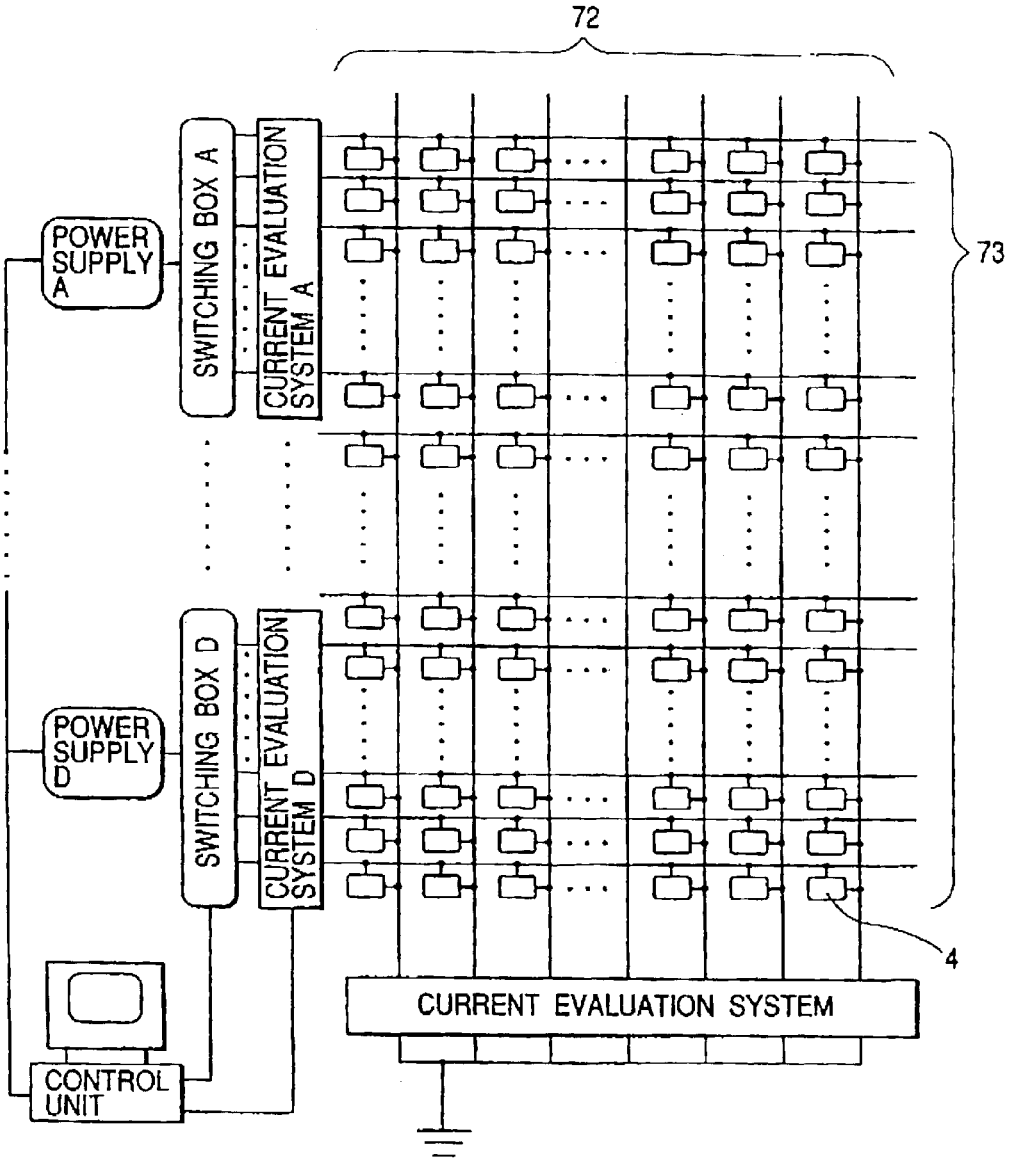
FIG. 26 is a schematic diagram illustrating a wiring method for the activation process according to a sixth embodiment.

FIG. 26 is a diagram showing a connection between external terminals of the envelope and power sources for supplying a voltage for the activation process.

External terminals Doy1 to Doyn (n=600) were grounded in common via a current measuring system constituted of an ammeter. External terminals Dox1 to Dox50, external terminals Dox51 to Dox100, external terminals Dox101 to Dox150, and external terminals Dox151 to Dox200 were connected via respective switching boxes A, B, C and D to power sources A, B, C and D. Current evaluation systems A, B, C and D each constituted of an ammeter for measuring current flowing through each wire were connected between the switching boxes and external terminals.

The power sources A to D were controlled by control signals supplied from a control unit to align the phases of activation waveforms. The switching boxes and corresponding power sources were synchronized in operation. In each line block of 50 lines including a block of Dox1 to Dox50, a block of Dox51 to Dox100, a block of Dox101 to Dox150, and a block of Dox151 to Dox200, 10 lines were selected and a voltage was applied time divisionally (in a scroll manner) to 10 lines. A voltage was therefore applied at the same time to four upper wires on the electron source substrate in the envelope so that the first activation process was executed for the electroconductive films 4 connected to the upper wires.

The voltage for the activation process was a rectangular pulse of both polarities having a peak value of ±14 V, a pulse width of 1 msec, and a pulse interval of 10 msec (FIG. 4B). Every tenth second (every 1000-th scroll), only one of the power sources A to D was activated by the control unit (by setting the output voltages of the other three power sources to 0), and 10 lines were selected from each line block of 50 lines including a block of Dox1 to Dox50, a block of Dox51 to Dox100, a block of Dox101 to Dox150, and a block of Dox151 to Dox200, and a voltage was applied time divisionally (in a scroll manner) to 10 lines during a period of 30 msec.

During the activation process, the current flowing through the lower wire was measured and a device current flowing through each electroconductive film connected to each upper wire was measured. When the average device current of 600 electroconductive films exceeded 2 mA during the activation process, the switching box was controlled to terminate the voltage application to the upper wire. This process was repeated five times to activate all the electroconductive films 4. The second stage activation process and succeeding process were similar to the second embodiment. A variation in the electron emission characteristics (If and Ie) of each electron-emitting device of this image-forming apparatus was measured. A variation was 10% a for If and 14% for Ie.

Seventh Embodiment

In the seventh embodiment, the termination timing of the first stage activation process was controlled by measuring the device current and emission current of the electron-emitting elements and evaluating the electron emission efficiency η. The processes up to the forming process were similar to the second embodiment.

<First Stage Activation Process>

The connection between external terminals of the envelope and power sources for supplying a voltage for the activation process shown in FIG. 24 was used. The activation voltage was applied through scrolling in the unit of 10 lines similar to the sixth embodiment. Every tenth second (every 1000-th scroll), only one of the power sources A to D was activated by the control unit (by setting the output voltages of the other three power sources to 0), and 10 lines were selected from each line block of 50 lines including a block of Dox1 to Dox50, a block of Dox51 to Dox100, a block of Dox101 to Dox150, and a block of Dox151 to Dox200, and a voltage was applied time divisionally (in a scroll manner) to 10 lines during a period of 30 msec.

During scrolling the upper wires every tenth second, a total value of the device current If flowing through 600 electroconductive films 4 connected to the upper wires and emission current Ie was measured. When the emission current was measured, a voltage of 100 V was supplied from a high voltage source (not shown) to the fluorescent film on the face plate.

The electron emission efficiency η (=emission current Ie/device current If) of each upper wire was calculated.

When this value became lower than 0.05%, the voltage application to the wire was stopped. This process was repeated five times to activate all the electroconductive films 4. The second stage activation process and succeeding process were similar to the second embodiment. A variation in the electron emission characteristics (If, Ie, and η) na) of each electron-emitting device of this image-forming apparatus was measured. A variation was 11% for If, 13% for Ie, and 13% for η.

Eighth Embodiment

The voltage application to the upper wire was terminated after 5 minutes after the current flowing though the upper wire exceeded 1 A during the first stage activation process of the second embodiment. The other conditions were similar to the second embodiment. A variation in the electron emission characteristics (If and Ie) of each electron-emitting device of this image-forming apparatus was measured. A variation was 10% for If and 12% for Ie.

Ninth Embodiment

Figure 27:
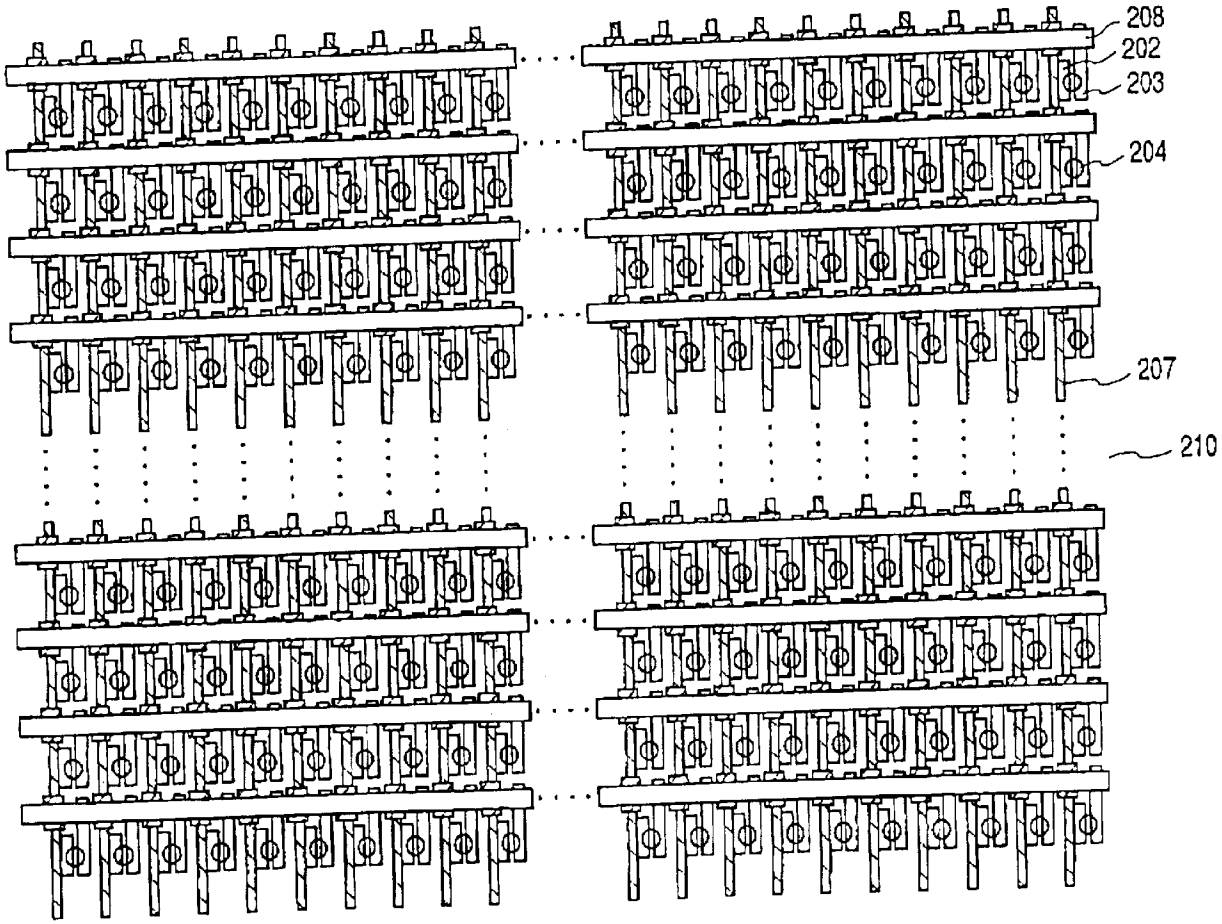
FIG. 27 is a diagram partially showing an electron source according to a ninth embodiment.
Figure 28:
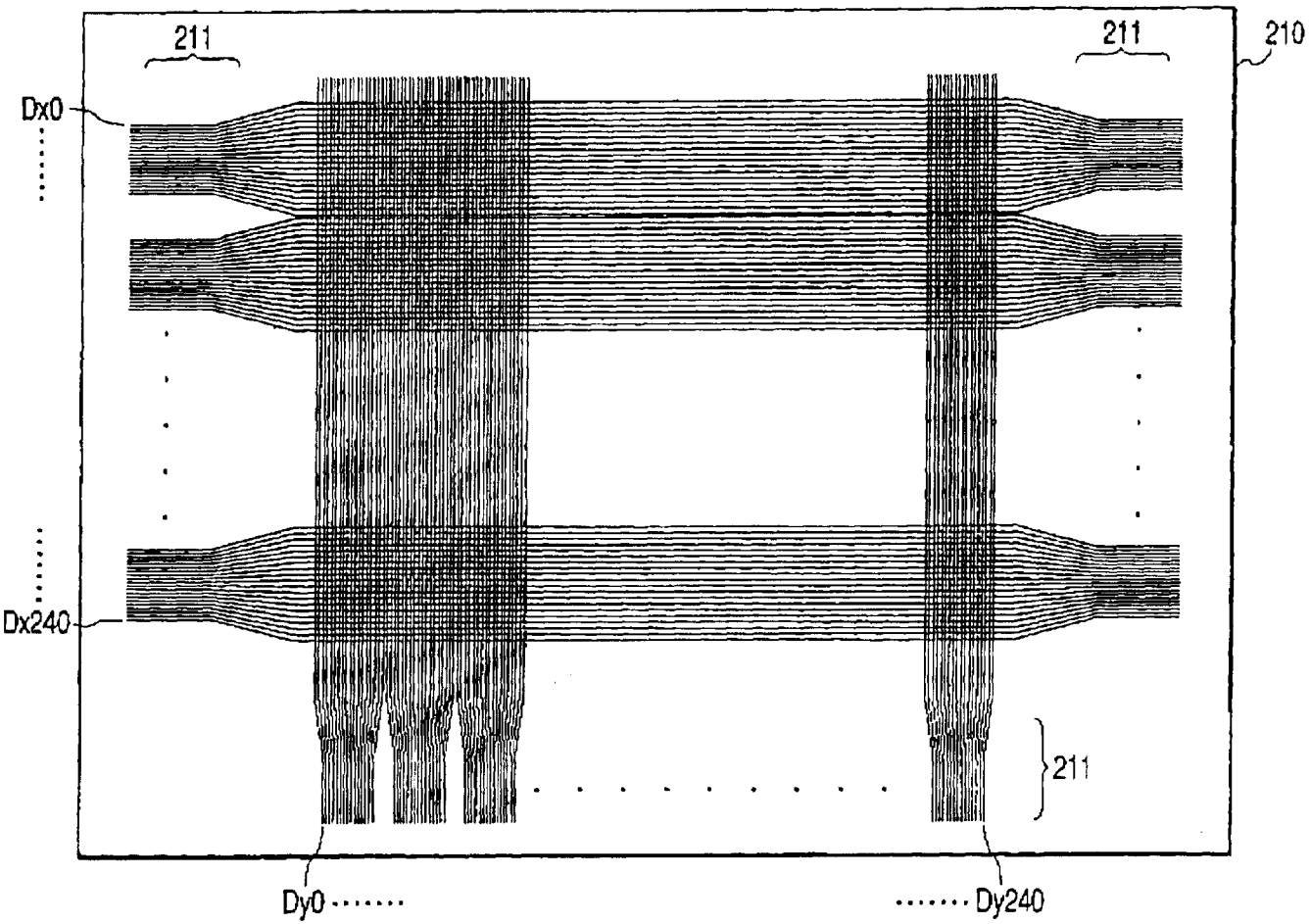
FIG. 28 is a schematic diagram showing wiring lead patterns on an electron source.

An electron source substrate having the structure shown in FIGS. 27 and 28 was manufactured as in the following.

First, on a glass substrate (size 350×300 mm, thickness 2.8 mm) formed with an $SiO_2$ layer, device electrodes 202 and 203 having a thickness of 50 nm were formed by printing Pt paste by an offset printing method and heating and baking it.

Next, column-directional wires (lower wires) 207 (720 wires) and row-directional wire (upper wires) 208 (240 wires) were formed by printing Ag paste by a screen printing method and heating and baking it. Next, the insulating films 209 were formed at cross points between the column-directional wires 207 and row-directional wires 208 by printing insulating paint by a screen printing method and heating and baking it. Then wiring lead patterns 211 were formed by a screen printing method in peripheral areas of the electron source substrate 210 to electrically connect the column-directional wires 207 and row-directional wires 208 to an external power source. An ITO film (100 nm thick) 218 was formed on the back surface of the glass substrate by sputtering in order to hold the substrate by an electrostatic chuck to be described later.

Next, droplets of palladium complex solution were applied between the device electrodes 202 and 203 by using a jet apparatus of an ink jet type, and then heated for 30 minutes at 350° C. to from electroconductive films 204 made of fine particles of palladium oxide. This thickness was 20 nm. With the above processes, an electron source substrate 210 was formed which had a plurality of electroconductive films 204 wired in a matrix shape by the plurality of row-directional wire 207 and column-directional wires 208.

By using a vacuum system such as shown in FIG. 11, the following forming process and activation process were executed for the electron source substrate 210 manufactured in the above manner.

As shown in FIG. 11, a surface area excepting the wiring lead patterns 211 (refer to FIG. 29) of the electron source substrate 210 on the substrate stage 215 was covered with the vacuum chamber 212. The O-ring 213 was disposed between the electron source substrate 210 and vacuum chamber 212, surrounding the device area of the electron source substrate. The device area was therefore sealed from the outer air. The electrostatic chuck 216 was mounted on the substrate stage 215 in order to fix the electron source substrate 210 to the stage. The electron source substrate 210 was chucked by applying 1 kV between the ITO film 214 formed on the back surface of the electron source substrate 210 and the electrode in the electrostatic chuck.

Next, the inside of the vacuum chamber was evacuated by the magnetically floating turbo molecular pump 217 and the forming processes and succeeding processes were executed in the following manner.

The inside of the vacuum chamber was degassed to a pressure of $10^{-4}$ Pa. The voltage was applied to the upper and lower wires by contacting contact pins to the wiring lead patterns 211 of each wire extending to the outside of the vacuum chamber. Contact pins Cox1 to Com (m=240) were made in contact with the wiring lead pattern 211 for the upper wires 208, and contact pins Coy1 to Coyn (n=720) (not shown) were made in contact with the wiring pattern 211 for the lower wires 207.

A rectangular pulse having a width of 1 msec was supplied from the external power source via the contact pins sequentially to the upper wires at the scroll frequency of 4.2 Hz.

The peak value was set to 12 V, and the lower wires were grounded.

A mixture gas of hydrogen and nitrogen (hydrogen 2%, nitrogen 98%) was introduced into the inside of the vacuum chamber, and the pressure was maintained at 1000 Pa. The flow of the gas was controlled by the mass controller 220, and the drain amount from the vacuum chamber was controlled by the evacuator and a flow control conductance valve 219. After the energization forming process was performed for 10 minutes, the current flowing through the electroconductive film became nearly zero. At this time, the voltage application was stopped and the mixture gas of hydrogen and nitrogen in the vacuum chamber was exhausted to complete the forming process. Fissures were formed in a plurality of electroconductive films on the electron source substrate to thus form electron-emitting regions.

Next, the activation process was executed by the following first and second stages.

<First Stage Activation Process>

P-tolunitrile was introduced into the vacuum chamber to a pressure of $1.3\times10^{-3}$ Pa.

Figure 29:
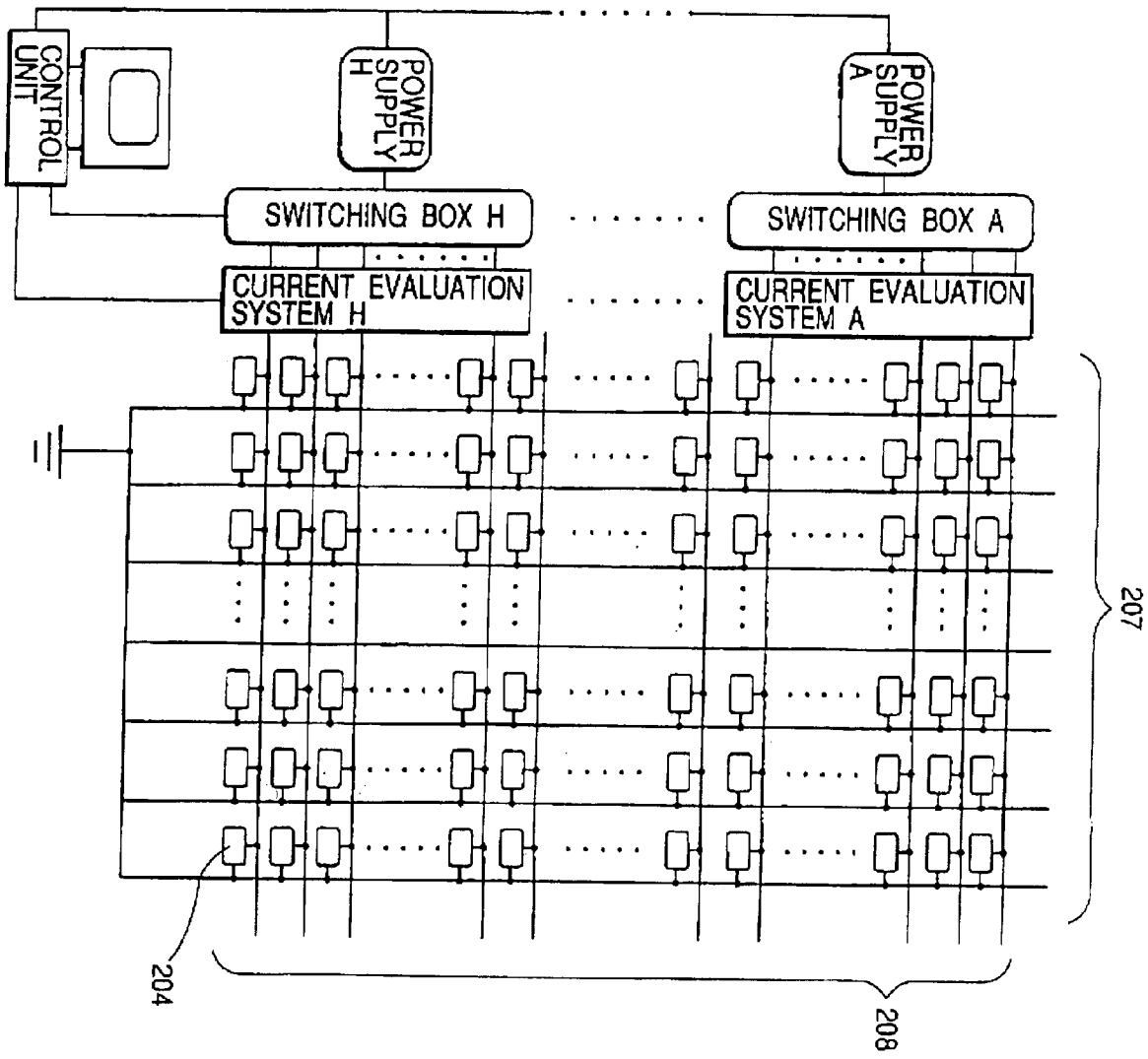
FIG. 29 is a schematic diagram illustrating a wiring method for the activation process according to the ninth embodiment.

FIG. 29 is a diagram showing a connection between external terminals of the envelope and power sources for supplying a voltage for the activation process.

The contact pins Coy1 to Coyn (n=720) in contact with the lower wires 207 were grounded in common. The contact pins Cox1 to Cox240 in contact with the upper wires 208 were divided into eight pin blocks each having 30 pins The eight pin blocks were connected via switching boxes A to H to power sources A to H. Current evaluation Systems A to H each constituted of an ammeter for measuring current flowing through each wire were connected between the switching boxes and contact terminals.

The power sources A to H were controlled by control signals supplied from a control unit to align the phases of activation waveforms. The switching boxes and corresponding power sources were synchronized in operation. In each pin block of 30 lines divided from Dox1 to Dox240, 10 lines were selected and a voltage was applied time divisionally (in a scroll manner) to 10 lines. A voltage was therefore applied at the same time to eight upper wires on the electron source substrate so that the first activation process was executed for the electroconductive films connected to the upper wires. The voltage for the activation process was a rectangular pulse of both polarities having a peak value of ±14 V, a pulse width of 1 msec, and a pulse interval of 10 msec (FIG. 4B).

While ten lines are scrolled, the current flowing through each upper wire was measured by the current evaluation system. When the current exceeded 1.3 A, the switching box was controlled to terminate the voltage application to the upper wire. This process was repeated three times to activate all the electroconductive films.

<Second Stage Activation Process>

The pressure of p-tolunitrile in the vacuum chamber was lowered to $1.3\times10^{-4}$ Pa. Similar to the first stage activation process, a voltage was time divisionally applied to ten lines and across the electrodes 2 and 3 connected to the corresponding conductive film to execute the second stage activation process. The voltage for this activation process was similar to the first stage activation process. The activation time was 30 minutes for each of the electroconductive films.

The device current flowing through the upper wire when the process was terminated was in a range from 1.0 A to 1.2 A.

The electron source substrate 210 subjected to the above processes was aligned in position with the face plate having the glass frame and phosphors, and they were sealed by using low melting point glass to form the vacuum envelope. Similar to the second embodiment, after the inside of the envelope was evacuated, the baking, sealing and other processes were executed to form the image-forming apparatus such as shown in FIG. 6.

A variation in the electron emission characteristics (If and Ie) of each electron-emitting device of this image-forming apparatus was measured. A variation was 9% for If and 10% for Ie.

Tenth Embodiment

In this embodiment, the electron source uses Spindt type electron-emitting devices.

Figure 30A:
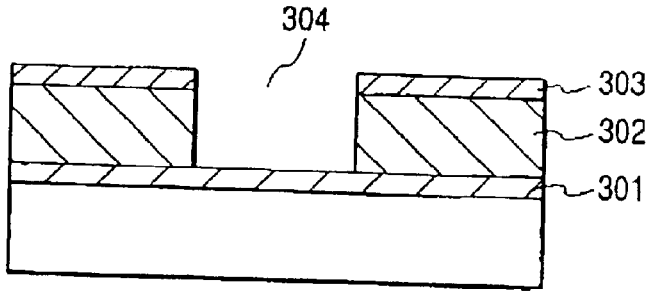
FIGS. 30A, 30B and 30C are diagrams illustrating processes of forming Spindt type electron-emitting devices.
Figure 30B:
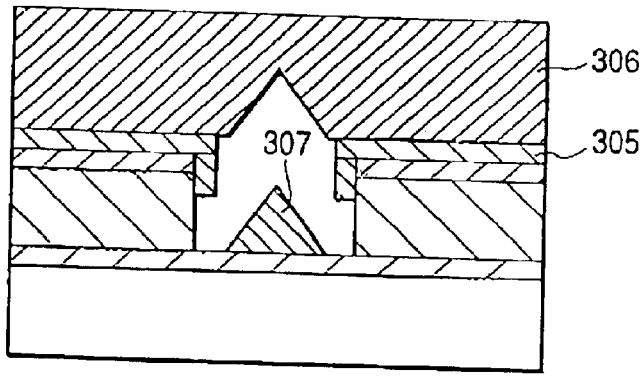
Figure 30C:
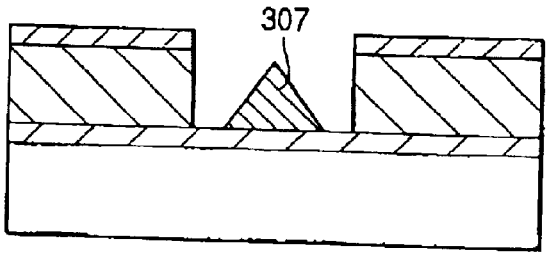
Figure 31:
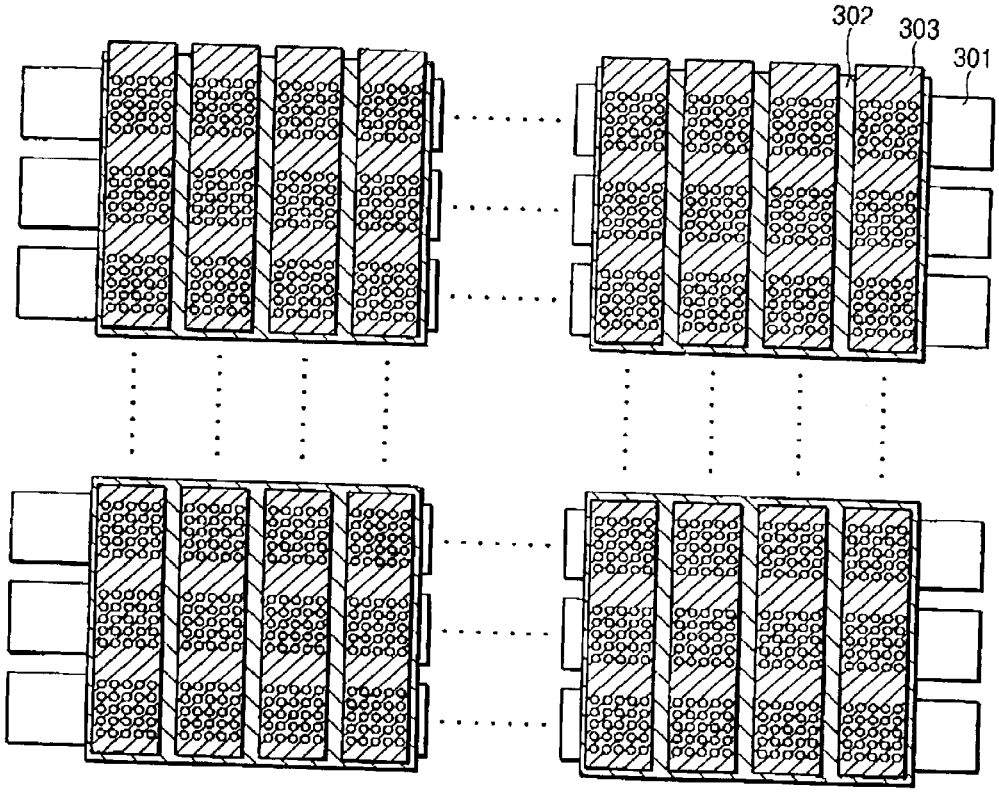
FIG. 31 is a diagram showing an example of an electron source using Spindt type electron-emitting devices.

FIGS. 30A to 30C are cross sectional diagrams illustrating a method of forming an electron-emitting device, and FIG. 31 is a plan view of the layout of electron-emitting devices disposed in a matrix shape.

On a glass substrate, after an alumina electrode film was deposited, an $SiO_2$ insulating film 302 was deposited and another alumina electrode film was deposited. This lamination was patterned in a stripe pattern to form cathode electrodes 301 and gate electrodes 303 in a matrix form.

A circular small hole 304 was formed through the gate electrode 303 and insulating film 302 by ordinary photolithography.

A sacrificial film 305 made of alumina or the like was vapor-deposited at a shallow angle relative to a conductive substrate 301. With this process, the gate hole diameter was reduced and the gate 303 was covered with the sacrificial film 305.

As an emitter electrode, molybdenum 306 was vapor-deposited along a vertical direction relative to the conductive substrate 301. As the vapor deposition progressed, the gate hole diameter reduced so that a conical cathode 307 was formed on the bottom of the small hole 304.

The sacrificial film 305 was wet etched and unnecessary molybdenum 306 was removed.

By using obtained field emission electron sources, an envelope was formed in the manner similar to the second embodiment.

Similar to the second embodiment, the inside of the envelope was degassed by a vacuum system and thereafter, the activation process was executed by using benzonitrile <First Stage Activation Process>

After benzonitrile was introduced into the envelope to a pressure of $1\times10^{-2}$ Pa, a voltage of 5 kV was applied to an anode electrode disposed at an upper position. In this state, a pulse voltage of 100 V was applied across the cathode electrode 301 and gate electrode 303 for 2 minutes. The anode current was measured. The measured result showed that the anode current increased by a tenfold of the anode current in a vacuum atmosphere not introducing benzonitrile.

<Second Stage Activation Process>

Next, after the pressure of benzonitrile in the envelope was lowered to $1\times10^{-4}$ Pa, a voltage of 5 kV was applied to the anode electrode. In this state, a pulse voltage of 100 V was applied across the cathode electrode 301 and gate electrode 303 for 20 minutes. In this period of 20 minutes, the anode current increased by a twofold.

After the activation process, the stabilization process was executed in the manner similar to the second embodiment, under the conditions of a pressure of about $1.33\times10^{-4}$ Pa and baking for 10 hours at 150° C. An unrepresented exhaust pipe was heated with a gas burner to melt it and seal the envelope.

The electron emission characteristics of each electron-emitting device of this image-forming apparatus were 14%.

According to the embodiments described above, in the activation process which processes a plurality of electron-emitting devices at the same time, it is possible to deposit carbon containing substance in the electron-emitting region and its nearby region without an insufficient supply of organic substance source gas. It is therefore possible to prevent uniformity of the electron emission characteristics from being otherwise degraded by an insufficient supply of organic substance gas. In the last activation process among a plurality of activation processes, the partial pressure of organic substance gas is set lower than in the preceding activation processes. It is therefore possible to optimize the electron emission characteristics and to make the intra- and inter-lot electron-emitting characteristics uniform and highly stable.

Accordingly, it is possible to provide an image-forming apparatus with less luminance variation, high quality and high stability, at good reproductivity. In the activation process, a plurality of electron-emitting devices can be formed at the same time without lowering the uniformity of the electron emission characteristics. It is possible to expect lower production cost because of a shortened tact time.

As described above, according to the present invention, it is possible to provide a method of manufacturing electron-emitting devices and an electron source, capable of performing an activation process in a short time.

The invention can also provide a method of manufacturing electron-emitting devices and an electron source, capable of forming a carbon or carbon compound film of good crystallinity by a short time activation process.

The invention can also provide a method of manufacturing an electron source having a plurality of electron-emitting elements, capable of executing the activation process in a short time.

The invention can also provide a method of manufacturing an electron source having a plurality of electron-emitting devices of good uniformity, capable of executing the activation process in a short time.

The invention can also provide a method of manufacturing an image-forming apparatus with uniform luminance characteristics.

What is claimed is:

1. A method of manufacturing an electron-emitting device, comprising the steps of:

forming a pair of conductors on a substrate, the conductors being spaced from each other; and an activation process of depositing carbon or carbon compound on at least one side of the pair of conductors in an atmosphere of carbon compound gas, wherein said activation process includes a plurality of processes of two or more stages including a first process and a second process, and the first process is executed in an atmosphere of the carbon compound gas having a partial pressure higher than a partial pressure of the carbon compound gas in the second process, and wherein the second process is the last activation process, wherein after said first process to the pair of conductors is terminated, a voltage is not applied between the pair of conductors in lowering the partial pressure of the carbon compound.

2. A method of manufacturing an electron source, comprising the steps of:

forming plural pairs of conductors on a substrate, the conductors being spaced from each other; and an activation process of depositing carbon or carbon compound on at least one side of each of the plural pairs of conductors in an atmosphere of carbon compound gas, wherein said activation process includes a plurality of processes of two or more stage including a first process and a second process, and the first process is executed in an atmosphere of the carbon compound gas having a partial pressure higher than a partial pressure of the carbon compound gas in the second process, and wherein the second process is the last activation process, wherein after said first process to all of the plural pairs of conductors on the substrate is terminated, a voltage is not applied between the conductors of each of the plural pairs in lowering the partial pressure of the carbon compound.

3. A method of manufacturing an electron source according to claim 2, wherein the plural pressure of the carbon compound gas in the first process is $5\times10^{-4}$ Pa or higher.

4. A method of manufacturing an electron source according to claim 2, wherein the partial pressure of the carbon compound gas in the second process is $5\times10^{-3}$ Pa or lower.

5. A method of manufacturing an electron source according to claim 2, wherein the partial pressure of the carbon compound is lowered by lowering a flow rate of carbon compound introduced from a carbon compound supply source into the atmosphere.

6. A method of manufacturing an electron source according to claim 2, wherein said activation step of depositing carbon or carbon compound includes a step of applying a voltage to each of the plural pairs of conductors in the atmosphere of the carbon compound gas.

7. A method of manufacturing an electron source according to claim 2, wherein said step of forming plural pairs of conductors includes a step of applying a voltage to each of the plural pairs of conductors on the substrate.

8. A method of manufacturing an electron source according to claim 2, wherein each of the plural pairs of conductors includes a pair of electroconductive films spaced from each other and a pair of electrodes respectively connected to the pair of electroconductive films.

9. A method of manufacturing an electron-emitting device, comprising the steps of:

forming an electroconductive film including an electron-emitting region and disposed between electrodes; and an activation process of depositing carbon or carbon compound on the electroconductive film in an atmosphere of carbon compound gas, wherein said activation process includes a plurality or processes of two or more stages including a first process and a second process, and the first process is executed in an atmosphere of the carbon compound gas having a partial pressure higher than a partial pressure of the carbon compound gas in the second process, and wherein the second process is the last activation process, wherein after said first process to the electroconductive film is terminated, a voltage is not applied between said electrodes in lowering the partial pressure of the carbon compound.

10. A method of manufacturing an electron-emitting device, comprising the steps of:

forming a plurality of electroconductive films each including an electron-emitting region and disposed between electrodes; and an activation process of depositing carbon or carbon compound on the electroconductive film in an atmosphere of carbon compound gas, wherein said activation process includes a plurality of processes of two or more stages including a first process and a second process, and the first process is executed in an atmosphere of the carbon compound gas having a partial pressure higher than a partial pressure of the carbon compound gas in the second process, and wherein the second process is the last activation process, wherein after said first process to all of the electroconductive films on the substrate is terminated, a voltage is not applied between the electrodes in lowering the partial pressure of the carbon compound.

11. A method of manufacturing an electron source according to claim 10, wherein the partial pressure of the carbon compound gas in the first process is $5\times10^{-4}$ Pa or higher.

12. A method of manufacturing an electron source according to claim 10, wherein the partial pressure of the carbon compound gas in the second process is $5\times10^{-3}$ Pa or lower.

13. A method of manufacturing an electron source according to claim 10, wherein the partial pressure of the carbon compound is lowered by lowering a flow rate of carbon compound introduced from a carbon compound supply source into the atmosphere.

14. A method of manufacturing an electron source according to claim 10, wherein said activation process of depositing carbon or carbon compound includes a step of applying a voltage between said electrodes in the atmosphere of the carbon compound gas.

15. A method of manufacturing an electron source according to claim 10, wherein said step of forming plural pairs of electroconductive films includes a step of applying a voltage to each of the plurality of electroconductive films.

16. A method of manufacturing an image-forming apparatus comprising a step of:

disposing a frame member-facing the electron source manufactured according to claim 2 or 10, the frame member including an image-forming member for forming an image by an electron beam emitted from the electron source.

* * * * *

UNITED STATES PATENT AND TRADEMARK OFFICE

CERTIFICATE OF CORRECTION

PATENT NO. : 6,824,437 B2
DATED : November 30, 2004
INVENTOR(S) : Kazuhiro Jindai et al.

It is certified that error appears in the above-identified patent and that said Letters Patent is hereby corrected as shown below:

Column 1,
Line 38, “region” should read -- region. --.

Column 2,
Line 22, “surface” should read -- surface. --.

Column 6,
Line 50, “applied” should read -- be applied --.

Column 34,
Line 57, “member-facing” should read --member facing --.

Signed and Sealed this

Seventeenth Day of May, 2005

JON W. DUDAS
*Director of the United States Patent and Trademark Office*